US005576165A

United States Patent [19]

Nozawa et al.

[11] Patent Number: 5,576,165

[45] Date of Patent: Nov. 19, 1996

[54] SILVER HALIDE COLOR PHOTOGRAPHIC MATERIAL

[75] Inventors: Yasushi Nozawa; Masakazu Morigaki, both of Kanagawa, Japan

[73] Assignee: Fuji Photo Film Co., Ltd., Kanagawa, Japan

[21] Appl. No.: 586,310

[22] Filed: Jan. 17, 1996

Related U.S. Application Data

[63] Continuation of Ser. No. 271,726, Jul. 7, 1994, abandoned.

[30] Foreign Application Priority Data

Jul. 7, 1993 [JP] Japan ..... 5-191815

[51] Int. Cl.[6] ..... G03C 1/34

[52] U.S. Cl. ..... 430/545; 430/546; 430/551; 430/552; 430/553; 430/599; 430/600; 430/631

[58] Field of Search ..... 430/545, 546, 430/551, 631, 531, 599, 600, 552, 553

[56] References Cited

U.S. PATENT DOCUMENTS

| | | | |
|---|---|---|---|
| H1,127 | 1/1993 | Shimazaki et al. | 430/551 |
| 3,432,300 | 3/1969 | Lestina et al. | 430/551 |
| 3,655,389 | 4/1972 | Yasuda et al. | 430/545 |
| 3,764,337 | 10/1973 | Arai et al. | 430/505 |
| 4,120,725 | 10/1978 | Nakazyo et al. | 430/545 |
| 4,526,864 | 7/1985 | Takada et al. | 430/551 |
| 4,863,840 | 9/1989 | Komorita et al. | 430/546 |
| 5,015,564 | 5/1991 | Chari | 430/546 |
| 5,132,202 | 7/1992 | Nishijima et al. | 430/551 |
| 5,332,655 | 7/1994 | Shono | 430/551 |

FOREIGN PATENT DOCUMENTS

| | | | |
|---|---|---|---|
| 1165756 | 7/1986 | Japan | 430/551 |
| 1210948 | 8/1989 | Japan . | |
| 1529908 | 12/1975 | United Kingdom . | |

*Primary Examiner*—Lee C. Wright

*Attorney, Agent, or Firm*—Sughrue, Mion, Zinn, Macpeak & Seas

[57] ABSTRACT

A silver halide color photographic material having improved stability with respect to fog and latent images, which contains at least one compound of formula (A) and at least one polymer having repeating units of formula (I) or (II):

(A)

wherein $R_{a1}$ to $R_{a5}$ are as defined in the specification (I)

wherein $R^1$ represents a hydrogen atom or an alkyl group; and Q represents a group selected from the group consisting of groups represented by formulae 1) to 4):

1)

2)

3)

4)

(wherein the definitions of each symbols are the same as in the application)

(II)

wherein E represents $—COR_{21}$, $—COOR_{22}$, $—CONHR_{23}$, $—CONHCOR_{24}$ or $—SO_2R_{25}$ (wherein $R_{21}$, $R_{22}$, $R_{23}$, $R_{24}$ and $R_{25}$ each represents an alkyl, aryl or cycloalkyl group, or a hydrogen atom); and G represents an alkylene group.

18 Claims, No Drawings

SILVER HALIDE COLOR PHOTOGRAPHIC MATERIAL

This is a Continuation of application Ser. No. 08/271,726 filed Jul. 7, 1994 (abandoned).

FIELD OF THE INVENTION

The present invention relates to a silver halide color photographic material and, more precisely, to a silver halide photographic material improved in that the latent image formed in the exposed material is not changed with the lapse of time and that the fog of the material is not increased during its storage.

BACKGROUND OF THE INVENTION

Improvements in the image qualities of color photographic materials, including their color reproducibility, sharpness and graininess, are noticeable in these days. However, there is no end to the user's demand for higher image qualities of photographic materials, and further improvements in photographic materials are desired.

Given the situations, various techniques for producing emulsions and couplers have been studied, obtaining excellent results.

However, many of these techniques often worsen the stability of photographic materials during storage. In particular, they often increase the fog of photographic materials or increase the latensification thereof during storage. Therefore, the technique for overcoming the problems has been desired.

Picture-taking photographic materials are developed, after having been exposed. The exposed materials may be developed immediately, but as the case may be, they are developed in several months or even in one year or more after exposure. Therefore, it is desired that the properties of the exposed photographic materials do not change with the lapse of time during storage. It has been known from the past that the stability of latent images in exposed photographic materials depends on the latent image fading which is seemingly caused by the decrease in the sensitivity of the materials and the latensification which, on the contrary, is seemingly caused by the increase in the sensitivity thereof. Recently, for example, there are known studies by E. F. Thurston in *The Journal of Photographic Science*, Vol. 38, pp. 34 to 40, 1990, in this regard.

It is well known in this technical field that the technique for increasing the sensitivity of silver halide emulsions for employing fine silver halide grains is the most important so as to improve the graininess of photographic materials. In order to increase the sensitivity of fine silver halide grains, investigation of reduction sensitization methods have been made in these days (for example, see JP-B 57-33572 (corresponding to U.S. Pat. No. 3,892,574), 58-1410 , JP-A 57-82831 (corresponding to U.S. Pat. No. 4,401,754), 57-179835, 2-136852 (corresponding to U.S. Pat. No. 5,254,456);—the terms "JP-B" and "JP-A" as used herein mean an "examined Japanese patent publication" and an "unexamined and published Japanese patent application", respectively), and these have obtained great results. However, it has been found that the increase of the sensitivity of photographic materials by reduction sensitization involves the increase of fogging during storage and the increase of latensification.

On the other hand, it has heretofore been known that the fog of photographic materials may be retarded and the desilverability thereof may be improved by incorporating polymers having repeating units derived from vinylpyrrolidone compounds (for example, see U.S. Pat. No. 3,505,067). However, the technique was still unsatisfactory for sufficiently inhibiting of fogging during storage and it was quite ineffective in retarding latensification.

JP-A-1-210948 has disclosed a technique of improving the image quality of photographic materials and of inhibiting fogging during atrage by employing polymers having repeating units derived from vinylpyrrolidone compounds and having a mean molecular weight of 30,000 or less and compounds that react with an oxidation product of a color developing agent and provide no image density.

By the present inventor's experiments, however, it has been found that the improvement in the inhibition of fogging during storage according on the method disclosed in JP-A-1-210948 is insufficient and that latensification is not retarded. It has rather been found that the compounds which react with an oxidation product of a color developing agent and provide no image density often increase latensification, and that the compounds have such an unfavorable side effect that they lower the sensitivity of photographic materials containing them.

SUMMARY OF THE INVENTION

The object of the present invention is to provide a silver halide color photographic material which is stable during storage, in particular, which is retarded to fog during storage and to change the latent image with the lapse of time.

This object can be attained by a silver halide color photographic material having at least one negative silver halide emulsion layer on a support, which contains at least one compound represented by general formula (A) and containing at least one polymer containing repeating units represented by formula (I) or (II):

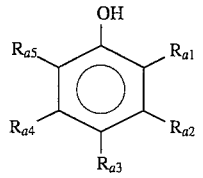

(A)

wherein $R_{a1}$ to $R_{a5}$ may be the same or different, and each represents ① a hydrogen atom, ② an alkyl group, ③ —X—$R_{a0}$, or ④ two of $R_{a1}$ to $R_{a5}$ which are ortho-positioned are bonded to each other to form a chroman ring with the benzene ring;

X represents —C($R_{a6}$)($R_{a7}$)—, —O— or —S—;

$R_{a6}$ and $R_{a7}$ each represent a hydrogen atom or an alkyl group; and $R_{a0}$ represents a hydroxyphenyl group, but this may be an alkyl group when X is —C($R_{a6}$)($R_{a7}$)—, $R_{a6}$ and $R_{a7}$ both are alkyl groups and $R_{a1}$ and $R_{a5}$ both represent —X—$R_{a0}$;

provided that $R_{a3}$ must not be a hydrogen atom, that at least one of $R_{a1}$ to $R_{a5}$ is the group of ③ or ④, and that both $R_{a1}$ and $R_{a5}$ must not be hydrogen atoms when $R_{a3}$ is —X—$R_{a0}$ and $R_{a0}$ is a hydroxyphenyl group.

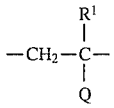

(I)

wherein $R^1$ represents a hydrogen atom or an alkyl group; and

Q represents a group chosen from among the following formulae 1) to 4):

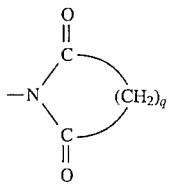

1)

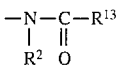

2)

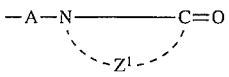

3)

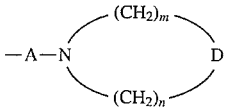

4)

in 1), q represents an integer of from 2 to 4;

in 2), $R^2$ and $R^{13}$ each represents a hydrogen atom or an alkyl group;

in 3), $Z^1$ represents an atomic group necessary for forming a lactam ring (such as pyridone ring and pyrrolidone ring), or an oxazolidone ring (such as 2-oxazolidone ring); A represents a single bond, —CO— or —CO—B—$(CH_2)_l$—; B represents —O— or —$NR_4$—, in which $R^4$ represents a hydrogen atom or an alkyl group; and l represents an integer of from 1 to 6; and in 4), A has the same definition as in 3); D represents a single bond, —O— or —$NR^5$—, m and n each represents an integer of from 1 to 6, provided that m+n=4 to 7; and $R^5$ represents a hydrogen atom, an alkyl group, or —CO—$R^6$ (wherein $R^6$ represents a substituted or unsubstituted alkyl group).

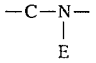

(II)

wherein E represents —$COR_{21}$, —$COOR_{22}$, —$CONHR_{23}$, —$CONHCOR_{24}$ or —$SO_2R_{25}$, in which $R_{21}$, $R_{22}$, $R_{23}$, $R_{24}$ and $R_{25}$ each represent a substituted or unsubstituted alkyl, aryl or cycloalkyl group, or a hydrogen atom; and G represents an alkylene group having from 2 to 5 carbon atoms.

DETAILED DESCRIPTION OF THE INVENTION

The present invention will be explained in more detail hereunder.

First, the compounds of formula (A) of the present invention will be explained concretely and in detail.

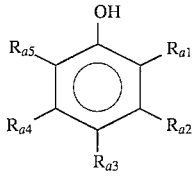

(A)

wherein $R_{a1}$ to $R_{a5}$ may be the same or different and each represents ① a hydrogen atom, ② an alkyl group, or ③ —X—$R_{a0}$, or ④ two of $R_{a1}$ to $R_{a5}$ which are ortho-positioned are bonded to each other to form a chroman ring;

X represents —$C(R_{a6})(R_{a7})$—, —O— or —S—;

$R_{a6}$ and $R_{a7}$ each represent a hydrogen atom or an alkyl group; and $R_{a0}$ represents a hydroxyphenyl group, but this may be an alkyl group when X is —$C(R_{a6})(R_{a7})$—, $R_{a6}$ and $R_{a7}$ are both alkyl groups and $R_{a1}$ and $R_{a5}$ both are —X—$R_{a0}$;

provided that $R_{a3}$ must not be a hydrogen atom, that at least one of $R_{a1}$ to $R_{a5}$ is the group of ③ or ④, and that both $R_{a1}$ and $R_{a5}$ must not be hydrogen atoms when $R_{a3}$ is —X—$R_{a0}$ and $R_{a0}$ is a hydroxyphenyl group.

The substituents referred in the present invention may further be substituted by at least one substituent.

Examples of preferred substituents include an alkyl group, an alkenyl group, an aryl group, a heterocyclic ring, a hydroxyl group, an alkoxy group, an aryloxy group, an alkoxycarbonyl group, an aryloxycarbonyl group and a halogen atom. Further examples include an amino group, an alkylamino group, an arylamino group, an alkylthio group, an arylthio group, an alkyl- and aryl-sulfonyl groups, an alkyl- and aryl-sulfinyl groups, an alkyl- and aryl-sulfonamido groups, an amido group, a carbamoyl group, a sulfamoyl group, an acyl group, an acyloxy group, a ureido group, and a urethane group (such as an alkoxycarbonylamino group and an aryloxycarbonylamino group). (In the present invention an acyl group (or moiety) includes an aliphatic and aromatic acyl groups (or moieties), and a heterocyclic ring preferably is a 5- to 7-membered ring containing at least one of N, O and S atoms.)

In formula (A), $R_{a1}$ to $R_{a5}$ may be the same or different and $R_{a1}$, $R_{a2}$, $R_{a4}$ and $R_{a5}$ each represents a hydrogen atom, and $R_{a1}$ to $R_{a5}$ each further represents an alkyl group (preferably having from 1 to 30, e.g., methyl, t-butyl, t-octyl, cyclohexyl, 2'-hydroxybenzyl, 4'-hydroxybenzyl), or (a) —X—$R_{a0}$, or (b) two of $R_{a1}$ to $R_{a5}$ which are ortho-positioned are bonded to each other to form a chroman ring with the benzene ring in formula (A). (In the present invention the number of carbon atoms of a group includes also the number of carbon atoms in the substituent if the group is subsituted.) Two pairs of $R_{a1}$ to $R_{a5}$ which are ortho-positioned may be bonded to form two dihydropyran rings each condensed with the benzene ring.

X represents —$C(R_{a6})(R_{a7})$—, —O— or —S—. $R_{a6}$ and $R_{a7}$ each represents a hydrogen atom or an alkyl group (preferably having from 1 to 26 carbon atoms, e.g., methyl, ethyl, propyl, isopropyl, octyl, cyclohexyl, benzyl, hexadecyl, methoxyethyl). $R_{a0}$ may be an alkyl group (preferably having from 1 to 26 carbon atoms, e.g., methyl, ethyl, propyl, isopropyl, octyl, cyclohexyl, benzyl, hexadecyl, methoxyethyl) when X is —$C(R_{a6})(R_{a7})$—, $R_{a6}$ and $R_{a7}$ both are alkyl groups and $R_{a1}$ and $R_{a5}$ both are —X—$R_{a0}$; while $R_{a0}$ is a hydroxyphenyl group (unsubstituted or substituted hydroxyphenyl group preferably having from 6 to 30 carbon atoms, e.g., o-hydroxyphenyl, m-hydroxyphenyl, p-hydroxyphenyl, 3-t-butyl-2-hydroxy-5-methylphenyl, 3,5-di-t-butyl-4-hydroxyphenyl) in the other cases. When $R_{a1}$ and $R_{a5}$ both are —X—$R_{a0}$, X is —C($R_{a6}$)($R_{a7}$)—, $R_{a6}$ and $R_{a7}$ both are an alkyl group, and $R_{a0}$ is an alkyl group, $R_{a3}$ is preferably alkyl group.

In formula (A), $R_{a3}$ must not be a hydrogen atom, and at least one of $R_{a1}$ to $R_{a5}$ is (a) or (b). When $R_{a3}$ is (a), preferred are bisphenols or trisphenols. More preferred are bisphenols.

Of the compounds of formula (A), especially preferred are those of the following general formulae (A-I) and (A-II) in view of the effects of the present invention. Most preferred are compounds of formula (A-II).

(A-I)

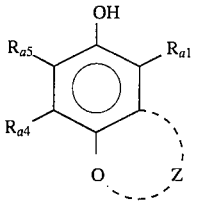

(A-II)

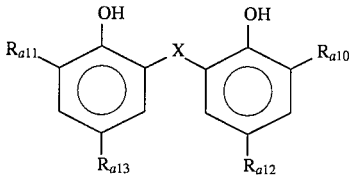

In formula (A-I), $R_{a1}$, $R_{a4}$ and $R_{a5}$ have the same meanings as those in formula (A). Z represents an atomic group necessary for forming a chroman ring.

The chroman ring may have at least one substituent, and may also form a condensed ring with a carbon ring or a heterocyclic ring. Furthermore, the chroman ring may form a spiro ring. In formula (A-I), $R_{a5}$ is preferably an alkyl group in view of the effects of the present invention.

In formula (A-II), X has the same meaning as that in formula (A). $R_{a10}$ to $R_{a13}$ each represents a substituted or unsubstituted alkyl group preferably having 1 to 30 carbon atoms. The alkyl group may be substituted with at least one of substituents described hereinabove. In formula (A-II), X is preferably —CH($R_{a6}$)— in view of the effects of the present invention, and in this case, $R_{a6}$ is especially preferably a hydrogen atom or an alkyl group having from 1 to 11 carbon atoms.

Specific examples of the compounds of formula (A) of the present invention are indicated below, which, however, are not intended to restrict the scope of the present invention. In the formula of the compounds (t)$C_8H_{17}$ indicates the following group:

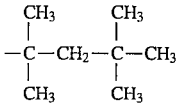

(A-1)

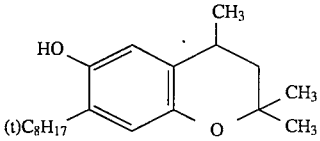

(A-2)

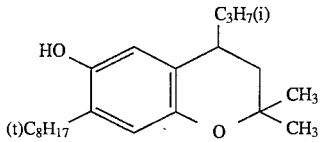

(A-3)

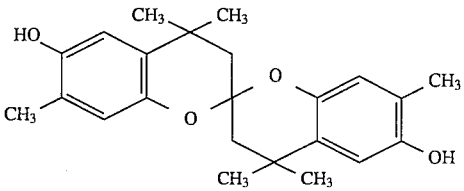

(A-4)

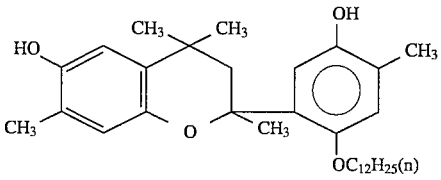

(A-5)

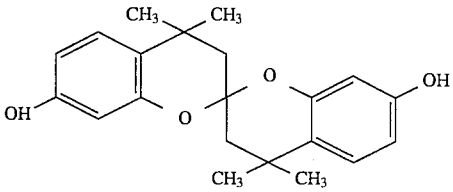

(A-6)

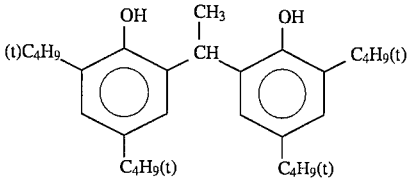

(A-7)

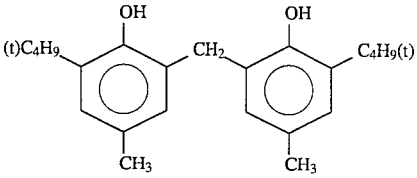

(A-8)

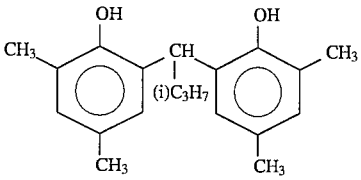

-continued
(A-9)
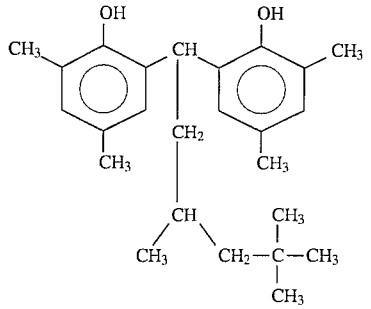
(A-10)
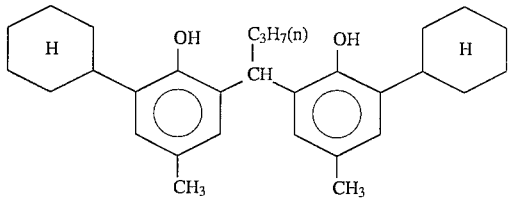
(A-11)
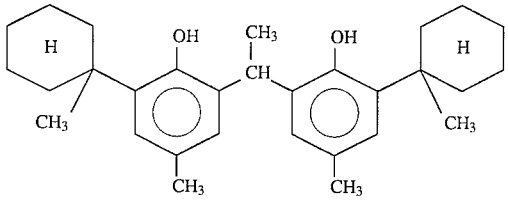
(A-12)
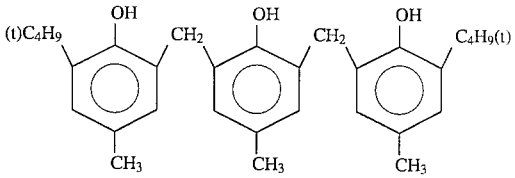
(A-13)
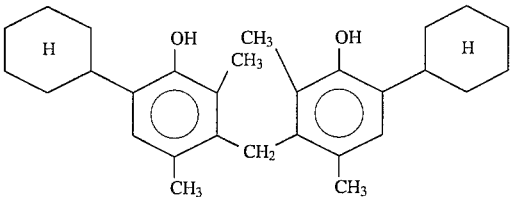
(A-14)
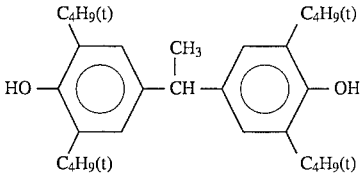
(A-15)
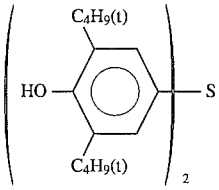
(A-16)
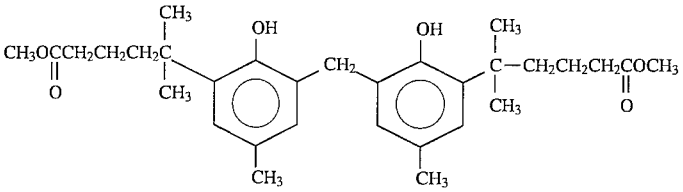
(A-17)
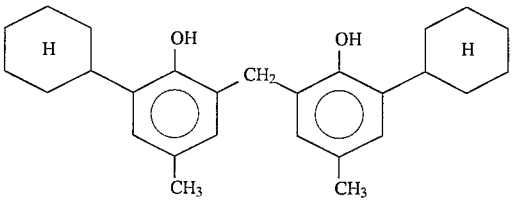
(A-18)
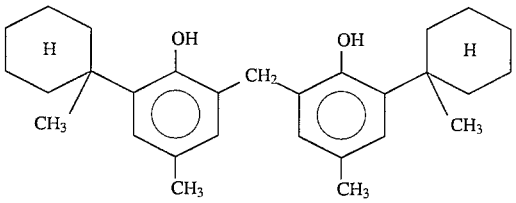
(A-19)
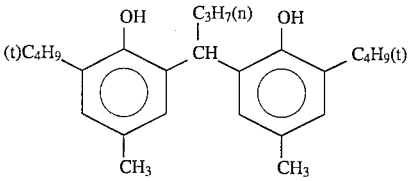
(A-20)
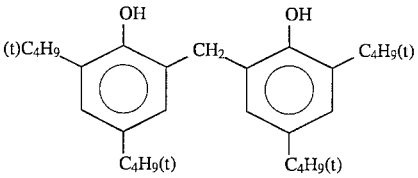

-continued
(A-21)
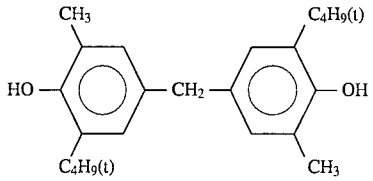
(A-22)
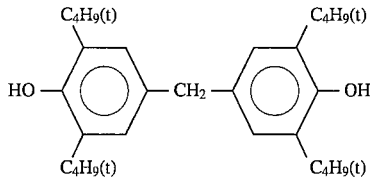
(A-23)
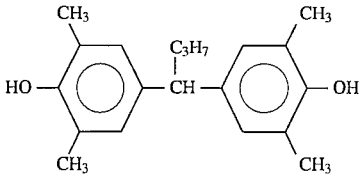
(A-24)
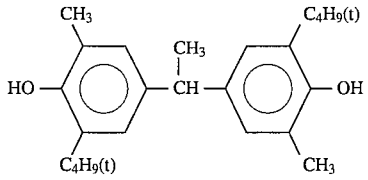
(A-25)
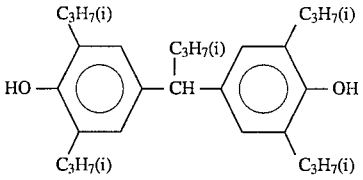
(A-26)
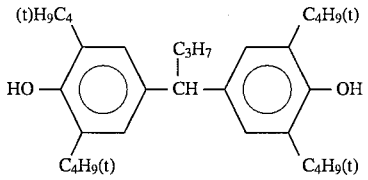
(A-27)
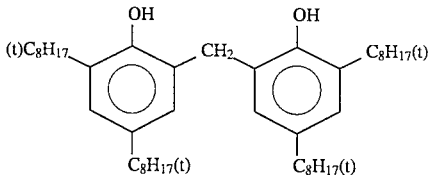
(A-28)
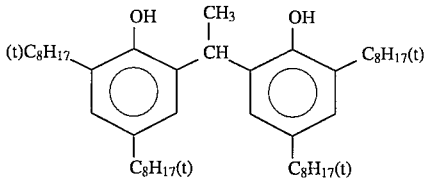
(A-29)
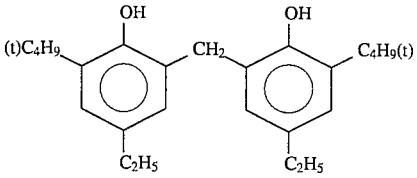
(A-30)
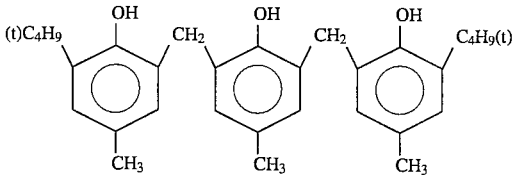
(A-31)
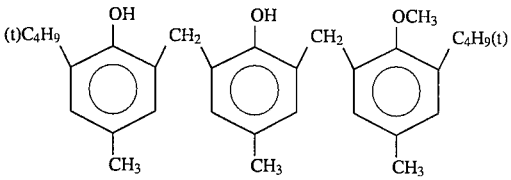
(A-32)
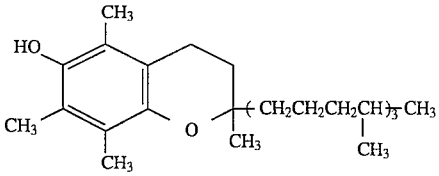
(A-33)
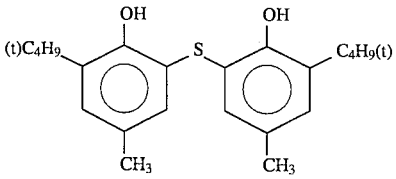
(A-34)
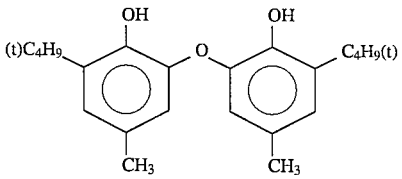
(A-35)
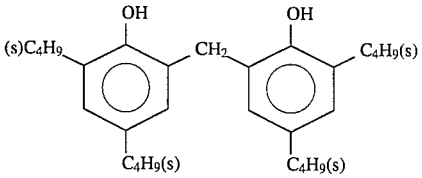
(A-36)
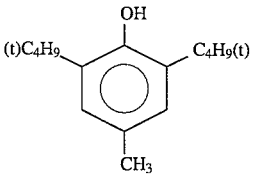

-continued (A-37)

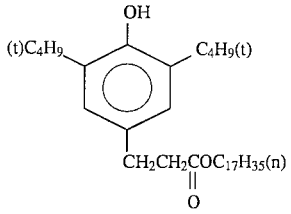

(A-38)

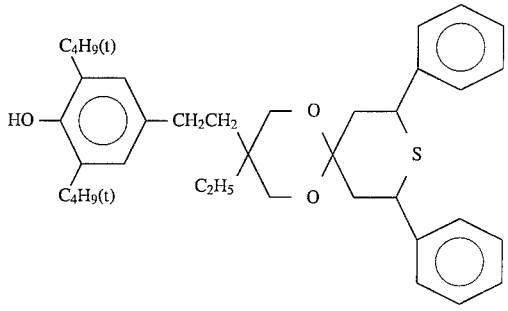

(A-39)

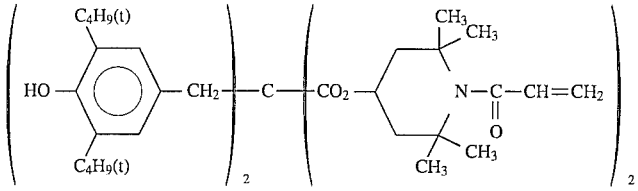

(A-40)

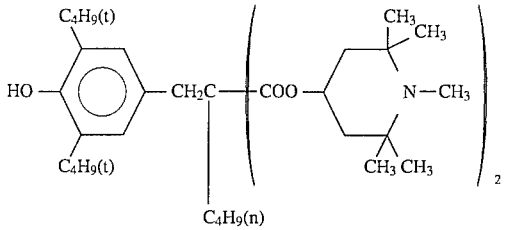

(A-41)

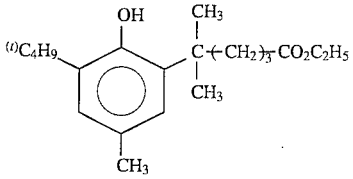

The compounds represented by formula (A) may be produced according on the methods or referring the methods disclosed in, for example, U.S. Pat. Nos. 2,792,428, 2,796,445, 2,841,619, 3,432,300, and 3,764,337, JP-B-40-16539, JP-A-50-6338, and K. Hultzsch, *J. Prakt. Chem.*, 159, pages 155–179 (1941).

The compound of formula (A) may be incorporated into any hydrophilic colloid layer in the photographic material of the present invention. Preferably, it is incorporated in at least one of a light-sensitive silver halide emulsion layer, a protective layer, and an interlayer. More peferably, it is incorporated into a light-sensitive silver halide emulsion layer.

For adding the compound of formula (A) to the photographic material, it may be dissolved in a solvent chosen from among water, alcohols, esters or ketones or in a mixed solvent comprising them and the resulting solution may be added to the material. If desired, the compound may be dissolved in a high boiling point organic solvent and the resulting solution may be dispersed in a coating composition. The latter is preferably combined with oil-soluble compounds of formula (A), since the compound may easily be fixed to the layer to which it is added. A method of adding the compounds of formula (A) along with couplers by coemulsification is also preferred. The compounds may be added into a coating composition at any step during the production thereof, however, it is preferable that the compound is added into a coating composition immediately before the coating.

The amount of the compound of formula (A) to be added to the photographic material of the present invention is preferably from $1\times10^{-4}$ to 10 mol, more preferably from $1\times10^{-3}$ to one mol, further preferably from $5\times10^{-3}$ to $1\times10^{-1}$ mol, per mol of the silver halide in the layer to which the compound is added. When the compound is added to a layer other than the silver halide emulsion layer the amount is determined based on the amount of the silver halide contained in the silver halide emulsion layer adjacent thereto (when there are two adjacent layers, the larger silver halide content is made as the base).

Next, the polymers having repeating units of formula (I) for use in the present invention will be explained in detail hereunder.

The amount of the polymer having repeating units of formula (I) to be added to the photographic material of the present invention shall be varied suitably in accordance with various conditions such as the kind of the polymer and the emulsion grains to be used. In general, in order to attain the intended effects of the present invention a smaller amount of the polymer may be added thereto than the amount thereof to be added when the polymer is used as a protective colloid or a binder. Therefore, the amount of the polymer to be added may be from 0.02 g to 10 g, preferably from 0.02 g to 7 g, more preferably from 0.1 g to 5 g, per mol of silver in the photographic material, in terms of the weight of the repeating units of formula (I) in the polymer. The polymer having the repeating units of formula (I) for use in the present invention will be explained in more detail.

Of the polymers having the repeating units of formula (I) for use in the present invention, preferred are those where $R^1$ is a hydrogen atom, and Q is a group chosen from among the following i) to iii):

i)

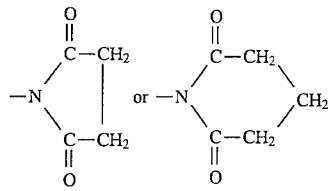

-continued

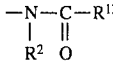

ii)

wherein $R^2$ is a methyl group or an ethyl group; and $R^{13}$ is a hydrogen atom, a methyl group or an ethyl group.

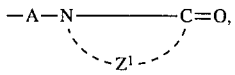

iii)

wherein A is a single bond or —CO—; and $Z^1$ forms a 5-membered or 6-membered lactam ring or oxazolidone ring.

Of these, especially preferred are those where Q is $—N(CH_3)—CO—CH_3$, a pyrrolidone residue group or an oxazolidone residue group, especially preferably a pyrrolidone residue group.

The polymers having the repeating units of formula (I) may be homopolymers and also be copolymers.

Specifically, they may be homopolymers or copolymers composed of one or more monomers of the following general formula (IA) or may also be copolymers composed of such monomer(s) and other ethylenic unsaturated compound(s) capable of being copolymerized with the former by addition polymerization.

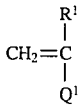

(IA)

wherein $Q^1$ represents a group chosen from among the following (1) to (4):

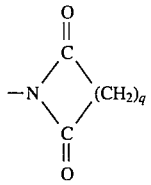

(1)

wherein q represents an integer of from 2 to 4.

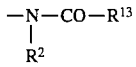

(2)

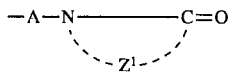

(3)

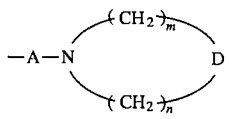

(4)

In these formulae, $R^1$, $R^2$, $R^{13}$, A, $Z^1$, m, n and D have the same meanings as those in formula (I).

Specific examples of the monomers of formula (IA) include N-vinylsuccinimide, N-vinylglutarimide, N-vinyladipimide, N-vinylacetamide, N-methyl-N-vinylformamide, N-methyl-N-vinylacetamide, N-ethyl-N-vinylacetamide, N-methyl-N-vinylpropionamide, N-vinylpyrrolidone, N-vinylpiperidone, N-vinyl-ε-caprolactam, N-vinyloxazolidone, N-acryloylpyrrolidone, N-acryloyloxyethylpyrrolidone, N-acryloylmorpholine, N-acryloylpiperidine, N-methacryloylmorpholine, N-β-morpholinoethylacrylamide, N-vinylmorpholine, and N-vinyl-2-pyridone. Of these, preferred are N-vinylsuccinimide, N-vinylglutarimide, N-methyl-N-vinylacetamide, N-ethyl-N-vinylacetamide, N-vinylpyrrolidone, N-vinylpiperidone and N-vinyloxazolidone. Especially preferred are N-methyl-N-vinylacetamide, N-vinylpyrrolidone and vinyloxazolidone.

Addition-polymerizable, ethylenic unsaturated compounds which may form copolymers along with the monomers of formula (IA) include, for example, acrylates, methacrylates, acrylamides, methacrylamides, allyl compounds, vinyl ethers, vinyl esters, vinyl-heterocyclic compounds, styrenes, maleates, fumarates, itaconates, crotonates, and olefins.

Specific examples of such compounds include methyl acrylate, ethyl acrylate, isopropyl acrylate, n-butyl acrylate, octyl acrylate, 2-chloroethyl acrylate, 2-cyanoethyl acrylate, N-(β-dimethylaminoethyl)acrylate, benzyl acrylate, cyclohexyl acrylate, phenyl acrylate; methyl methacrylate, n-propyl methacrylate, isopropyl methacrylate, n-butyl methacrylate, cyclohexyl methacrylate, 3-sulfopropyl methacrylate; allyl butyl ether, allyl phenyl ether; methyl vinyl ether, butyl vinyl ether; methoxyethyl vinyl ether, 2-hydroxyethyl vinyl ether, (2-dimethylaminoethyl)vinyl ether, vinyl phenyl ether, vinyl chlorophenyl ether; acrylamide, methacrylamide, N-methylacrylamide, N-(1,1-dimethyl-3-oxobutyl)acrylamide, N-(1,1-dimethyl-3-hydroxybutyl)acrylamide, N,N-dimethylacrylamide, acryloylhydrazine, N-methoxymethyl-methacrylamide, N-(1,1-dimethyl-3-hydroxybutyl)-methacrylamide, N-hydroxymethylacrylamide; vinylpyridine, N-vinylimidazole, N-vinylcarbazole, vinylthiophene; styrene, chloromethylstyrene, p-acetoxystyrene, p-methylstyrene; p-vinylbenzoic acid, methyl p-vinylbenzoate; crotonamide, butyl crotonate, glycerine monocrotonate; methyl vinyl ketone, phenyl vinyl ketone; ethylene, propylene, 1-butene, dicyclopentadiene, 4-methyl-1-hexene, 4,4-dimethyl-1-pentene; methyl itaconate, ethyl itaconate, diethyl itaconate; methyl sorbate, ethyl maleate, butyl maleate, dibutyl maleate, octyl maleate; ethyl fumarate, dibutyl fumarate, octyl fumarate; halogenated olefins such as vinyl chloride, vinylidene chloride, isoprene; unsaturated nitriles such as acrylonitrile, methacrylonitrile. If desired, two or more of them may be used as comonomers.

Of these, preferred are acrylic acid, methacrylic acid, 2-hydroxyethyl acrylate, 2-methoxyethyl acrylate, sulfopropyl acrylate, acrylamide, dimethylacrylamide, 2-acryloylamino-2-methylpropanesulfonic acid, hydroxyethylacrylamide, methacrylamide, methyl vinyl ether, sodium styrenesulfonate, N-vinyl-3,5-dimethyltriazole and maleic anhydride, since the copolymers to be produced are hydrophilic. The composition ratio of the copolymers having the repeating units of formula (I) is not specifically defined. However, the content of the components of formula (I) in the copolymers is preferably from 10 to 100 mol %, more preferably from 50 to 100 mol %, especially preferably 100 mol %.

For producing the polymers or copolymers having the repeating units of formula (I) methods, for example, described in British Patent 1,211,039, JP-B 47-29195, JP-A 48-76593, 48-92022, 49-21134, 49-120634, British Patent 961,395, U.S. Pat. Nos. 3,227,672, 3,290,417, 3,262,919, 3,245,932, 2,681,897, 3,230,275; John C. Petropulos et al, *Official Digest*, Vol. 33, pp. 719 to 736 (1961); S. Murahashi et al, *Synthetic Polymers*, Vol. 1, pp. 246 to 290; ibid., Vol. 3, pp. 1 to 108 can be referred. Needless-to-say, various polymerization initiators may be used, and concentrations, polymerization temperatures and reaction times may be widely varied with ease.

For instance, the polymerization may be conducted generally at 20° to 180° C., preferably at 40° to 120° C., generally using a radical polymerization initiator in an amount of from 0.05 to 5 % by weight relative to the monomers to be polymerized. As the initiator, for example, usable are azobis compounds, peroxides, hydroperoxides and redox catalysts, such as potassium persulfate, tert-butyl peroctoate, benzoyl peroxide, azobisisobutyronitrile, 2,2'-azobiscyanovaleric acid and 2,2'-azobis-(2-amidinopropane hydrochloride).

The above-mentioned polymers for use in the present invention generally have a molecular weight of about 2,000 or more, preferably approximately from 8,000 to 700,000. However, the values are not critical for obtaining the effects of the present invention.

Specific examples of the polymers having the repeating units of formula (I) for use in the present invention are indicated below, in which the number as parenthesized by () means the number average molecular weight of the polymer.

(1) Poly(N-vinylpyrrolidone) ($1.5\times10^4$)
(2) Poly(N-vinyloxazolidone) ($1\times10^4$)
(3) Poly(N-vinylsuccinimide) ($1\times10^4$)
(4) Poly(N-vinylglutarimide) ($1\times10^4$)
(5) Poly(N-vinylpiperidone) ($1\times10^5$)
(6) Poly(N-vinyl-ε-caprolactam) ($1\times10^4$)
(7) Poly(N-methyl-N-vinylacetamide) ($1\times10^4$)
(8) Poly(N-ethyl-N-vinylacetamide) ($1\times10^4$)
(9) Poly(N-vinylacetamide) ($1\times10^4$)
(10) Vinyl alcohol/N-vinylacetamide copolymer (molar ratio, 30/70) ($1\times10^4$)
(11) Vinyl alcohol/N-vinylpyrrolidone copolymer (molar ratio, 20/80) ($5\times10^4$)
(12) Vinyl alcohol/N-vinylpyrrolidone copolymer (molar ratio, 30/70) ($1.5\times10^4$)
(13) N-vinylpyrrolidone/vinyl acetate copolymer (molar ratio, 30/70) ($1\times10^4$)
(14) N-vinylpyrrolidone/2-hydroxyethyl acrylate copolymer (molar ratio, 30/70) ($1\times10^4$)
(15) N-vinylpyrrolidone/acrylic acid copolymer (molar ratio, 30/70) ($1\times10^4$)
(16) N-vinylpyrrolidone/N-vinyl-3,5-dimethyltriazole copolymer (molar ratio, 50/50) ($1\times10^4$)
(17) N-vinylpiperidone/2-methoxyethyl acrylate copolymer (molar ratio, 70/30) ($5\times10^3$)
(18) N-vinylpiperidone/methyl vinyl ether copolymer (molar ratio, 90/10) ($5\times10^3$)
(19) N-vinyloxazolidone/vinyl alcohol copolymer (molar ratio, 65/35) ($1\times10^4$)
(20) N-vinyloxazolidone-acrylic acid copolymer (molar ratio, 80/20) ($1\times10^4$)
(21) N-vinylpyrrolidone/N-vinylpiperidone/2-hydroxyethyl acrylate copolymer (molar ratio, 40/30/30) ($1\times10^4$)
(22) Vinyl alcohol/vinyl acetate/N-vinyl-2-pyridone copolymer (molar ratio, 70/25/5) ($1\times10^4$)
(23) N-vinylpyrrolidone/2-hydroxyethyl acrylate/vinyl acetate copolymer (molar ratio, 70/20/20) ($1\times10^4$)
(24) N-vinylpyrrolidone/vinyl alcohol/vinyl propionate/sodium styrenesulfonate copolymer (molar ratio, 40/40/5/15) ($1\times10^4$)
(25) N-vinylpyrrolidone/acrylamide copolymer (molar ratio, 60/40) ($1\times10^4$)
(26) N-vinylpyrrolidone/2-acrylamide-2-methylpropanesulfonic acid copolymer (molar ratio, 75/25) ($1\times10^4$)
(27) N-vinylpiperidone-acrylamide copolymer (molar ratio, 60/40) ($1\times10^4$)
(28) N-vinyloxazolidone/N-(2-hydroxyethyl)acrylamide copolymer (molar ratio, 70/30) ($1\times10^4$)
(29) N-vinyloxazolidone/N-vinylmorpholine/acrylamide copolymer (molar ratio 50/20/30) ($1\times10^4$)
(30) N-vinylsuccinimide/N-vinyl-ε-caprolactam/acrylamide copolymer (molar ratio, 40/20/40) ($1\times10^4$)
(31) N-vinyloxazolidone/acrylamide/acrylic acid copolymer (molar ratio, 60/20/20) ($1\times10^4$)
(32) N-vinylpyrrolidone/acrylamide/vinyl acetate/acrylic acid copolymer (molar ratio, 60/20/10/10) ($1\times10^4$)
(33) N-vinylpyrrolidone/dimethylacrylamide copolymer (molar ratio, 70/30) ($1\times10^4$)

The copolymers having repeating units of the following general formula (II) for use in the present invention will then be explained hereunder.

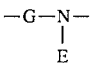

(II)

wherein E represents $—COR_{21}$, $—COOR_{22}$, $—CONHR_{23}$, $—CONHCOR_{24}$ or $—SO_2R_{25}$, wherein $R_{21}$, $R_{22}$, $R_{23}$, $R_{24}$ and $R_{25}$ each represent a substituted or unsubstituted alkyl group preferably having 1 to 20 carbon atoms (e.g., methyl, ethyl, isobutyl, octadecyl, monochloromethyl, hydroxyethyl), aryl group preferably having 6 to 20 carbon atoms (e.g., phenyl, tolyl, naphthyl) or cycloalkyl group preferably having 3 to 20 carbon atoms (e.g., cyclopropyl, cyclohexyl, halogen-substituted cyclohexyl), or a hydrogen atom; and G represents an alkylene group having from 2 to 5 carbon atoms (e.g., ethylene, propylene, isopropylene).

The polymer having the repeating units of the above-mentioned formula (II) includes, for example, homopolymers or copolymers to be obtained by ring-opening polymerization of at least one endo-imino cyclic compound of the following general formula (IIB); alternate copolymers composed of at least one such endo-imino cyclic compound and betapropiolactones, propanesultones, etc.; polymers to be obtained by ring-opening polymerization of ethyleneimides; and polymers to be obtained by reacting polymers obtained by ring-opening polymerization of ethyleneimine with acid anhydrides (e.g., acetic anhydride, propionic anhydride, succinic anhydride, phthalic anhydride), acid halides (e.g., acetyl chloride, isobutyric acid chloride, lauric acid chloride, benzyl chloride, methanesulfonic acid chloride), chloroformates (e.g., methyl chloroformate, ethyl chloroformate, dodecyl chloroformate) or isocyanates (e.g., ethyl isocyanate, hexyl isocyanate, phenyl isocyanate).

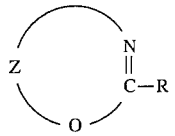

(IIB)

wherein R represents a substituted or unsubstituted alkyl group preferably having 1 to 20 carbon atoms (e.g., methyl, ethyl, isobutyl, octadecyl, monochloromethyl, acetacetyl), aryl group preferably having 6 to 20 carbon atoms (e.g., phenyl, tolyl, naphthyl) or cycloalkyl group preferably having 3 to 20 carbon atoms (e.g., cyclopropyl, cyclohexyl, halogen-substituted cyclohexyl) group, or a hydrogen atom; and Z represents an alkylene group having from 2 to 5 carbon atoms (e.g., ethylene, propylene, isopropylene).

Where the polymer having the repeating units of formula (II) for use in the present invention is in the form of a copolymer, it preferably contains 5 mol % or more, more preferably 10 mol % or more, of the component of formula (II) in order to attain favorable results of the present invention.

The polymers having the repeating units of formula (II) for use in the present invention may be obtained by various methods. For example, U.S. Pat. No. 3,483,141, *J. Polymer*

*Sci.*, Part A-1, Vol. 6, pp. 57 to 62 (1968), *J. Polymer Sci. Polymer Letters*, Vol. 5, pp. 871–879 (1967) and JP-A 47-42987 mention that the polymers of the present invention may be obtained by heating the above-mentioned endo-imino cyclic compounds and a cationic polymerization catalyst (e.g., dimethyl sulfate, methyl paratoluenesulfonate, methyl iodide, stannic chloride, boron trifluoride etherate, etc.) in the absence or, if desired, in the presence of a suitable solvent (e.g., acetonitrile, nitrobenzene, dimethylformamide, etc.), at 50° C. to 180° C., preferably 60° C. to 120° C., for 6 hours to 48 hours.

To obtain copolymers composed of endo-imino cyclic compounds and gamma-propiolactones or propanesultones, the disclosure in *Macromolecules*, Vol. 5, pp. 354 to 358 and the report by T. Saegusa, K. Ikeda, S. Hirayanagi et al (in 19th Meeting for Reading Research Papers on Polymers, at Kobe in 1973) may be referred to. A method of producing the polymers for use in the present invention by ring-opening polymerization of ethyleneimides is described in, for example, *Journal of Industrial Chemistry*, Vol. 58, pp. 123 to 126 (1955).

To obtain the polymers of the present invention by reacting polyethyleneimines (obtained by polymerizing ethyleneimine with acid anhydrides), acid halides, chloroformates or isocyanates, known methods may be employed. For instance, polyethyleneimines are dissolved in a suitable solvent (e.g., water, pyridine, dimethylformamide) and reacted with corresponding acid anhydrides, acid chlorides, chloroformates or isocyanates, if desired, while cooling, to obtain the polymers.

The degree of polymerization of the polymers having the repeating units of formula (II) for use in the present invention is preferably from 10 to 10,000, especially preferably from 50 to 500 or so. However, these values are not critical for obtaining the effects of the present invention.

Specific examples of the polymers having the repeating units of formula (II) for use in the present invention are mentioned below, which, of course, are not limitative.

I. Polymers obtained by ring-opening polymerization of endo-imino cyclic compounds:

P-1. Polymer formed by ring-opening polymerization of 2-methyloxazoline, having repeating units, as the constitutive components of the polymer (hereinafter referred to as "repeating units") of:

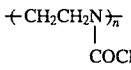

(n = 200)

P-2. Polymer formed by ring-opening polymerization of 2-isopropyloxazoline, having repeating units of:

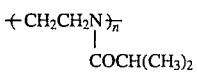

(n = 150)

P-3. Polymer formed by ring-opening polymerization of 2-n-octyloxazoline, having repeating units of:

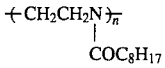

(n = 128)

P-4. Polymer formed by ring-opening polymerization of 2-dichloromethyloxazoline, having repeating units of:

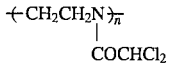

(n = 135)

P-5. Polymer formed by ring-opening polymerization of 2-trifluoromethyloxazoline, having repeating units of:

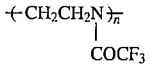

(n = 215)

P-6. Polymer formed by ring-opening polymerization of 2-(betamethoxycarbonyl)ethyloxazoline, having repeating units of:

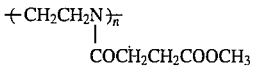

(n = 80)

P-7. Polymer formed by ring-opening polymerization of 2-phenyloxazoline, having repeating units of:

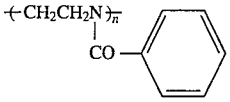

(n = 121)

P-8. Polymer formed by ring-opening polymerization of 2-cyclohexyloxazoline, having repeating units of:

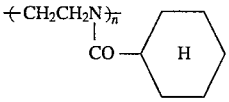

(n = 50)

P-9. Polymer formed by ring-opening polymerization of 2,5-dimethyl-2-oxazoline, having repeating units of:

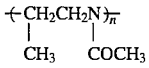

(n = 41)

P-10. Polymer formed by ring-opening polymerization of 2-methyl-5,6-dihydro-1,3-oxazine, having repeating units of:

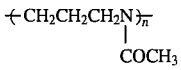

(n = 30)

P-11. 2-Methyloxazoline/2-ethyloxazoline copolymer, having repeating units of:

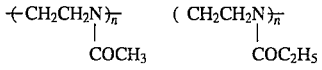

(molar ratio, 50/50; n = 55)

II. Alternate copolymers composed of endo-imino cyclic compounds and other monomers:

P-12. Alternate copolymer of 2-methyloxazoline and propanesultone, having repeating units of:

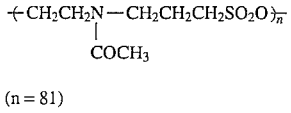

(n = 81)

P-13. Alternate copolymer of 2-oxazoline and betapropiolactone, having repeating units of:

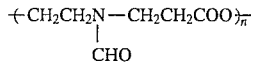

(n = 20)

III. Polymers formed by ring-opening polymerization of ethyleneimides:

P-14. Polymer formed by ring-opening polymerization of acetacetic acid ethyleneimide, having repeating units of:

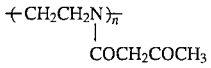

(n = 62)

IV. Polymers formed by reacting polyethyleneimines (obtained by polymerizing ethyleneimine) with acid anhydrides, etc.:

P-15. Polymer formed by reacting polyethyleneimine (n=80) and acetic anhydride, having repeating units of:

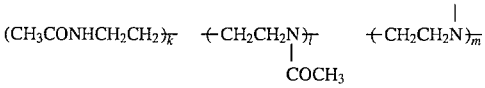

(composition ratio, k/l/m=24/53/23)

(composition ratio=molar ratio)

P-16. Polymer formed by reacting polyethyleneimine (n=50) and succinic anhydride, having repeating units of:

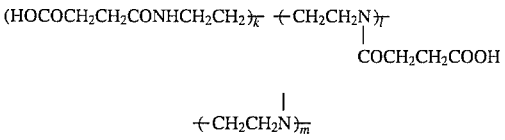

(composition ratio, k/l/m=25/51/24)

P-17. Polymer formed by reacting polyethyleneimine (n=100) and methyl chloroformate, having repeating units of:

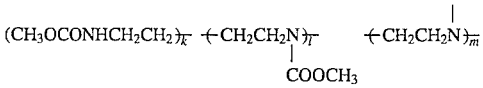

(composition ratio, k/l/m=23/50/27)

P-18. Polymer formed by reacting polyethyleneimine (n=80) and octyl chloroformate, having repeating units of:

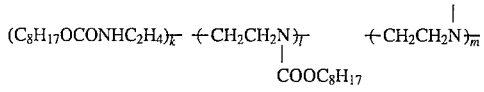

(composition ratio, k/l/m=24/53/23)

P-19. Polymer formed by reacting polyethyleneimine (n=80) and ethyl isocyanate, having repeating units of:

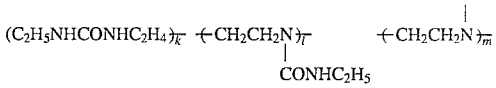

(composition ratio, k/l/m=25/52/23)

P-20. Polymer formed by reacting polyethyleneimine (n=80) and paratolyl-isocyanate, having repeating units of:

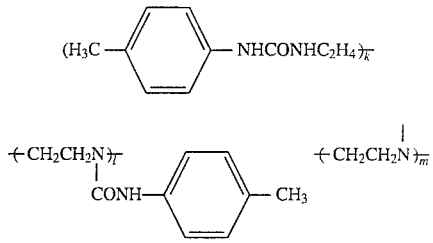

(composition ratio, k/l/m=24/53/23)

P-21. Polymer formed by reacting polyethyleneimine (n=100) and acetyl isocyanate, having repeating units of:

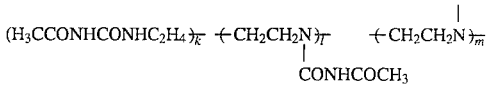

(composition ratio, k/l/m=23/50/27)

P-22. Polymer formed by reacting polyethyleneimine (n=80) and methanesulfonyl chloride, having repeating units of:

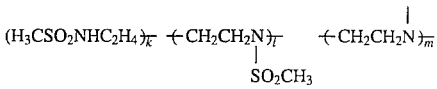

(composition ratio, k/l/m=24/51/25)

Of the polymers having the repeating units of formula (I) or (II) for use in the present invention, especially preferred are those composed of only the repeating units of formula (I). More preferred are polymers composed of only N-methyl-N-vinylacetamide, N-vinylpyrrolidone or N-vinyloxazolidone.

The amount of the polymer having the repeating units of formula (II) to be added to the light-sensitive silver halide emulsion layer of the photographic material may selected freely, but it is preferably 1 to 500 g, especially preferably 5 to 300 g, per mol of the silver halide in the layer. If the polymer is added to non-light-sensitive auxiliary layers of the photographic material, the amount thereof is not specifically defined but it is preferably 1 to 1000 g, especially preferably 10 to 500 g, per mol of the silver halide in the adjacent silver halide emulsion layer (which has a larger silver halide content, if there are two adjacent silver halide emulsion layers).

The polymers for use in the present invention are preferably soluble in water. If they are hardly soluble in water, they may be dissolved in water-miscible organic solvents (e.g., methanol, acetone, dioxane, dimethylformamide) and the resulting solutions may be incorporated into the photographic material. As the case may be, if desired, they may be dissolved in water-immiscible organic solvents (e.g., ethyl acetate, butyl acetate, dibutyl phthalate, N,N-diethyldodecanamide) to prepare aqueous dispersions (oil-protected dispersions) and they may be incorporated into the photographic material.

Where the polymers having the repeating units of formula (I) or (II) of the present invention are desired to be incorporated into light-sensitive emulsion layers, in general, they are added to the emulsions at any stage after the chemical ripening of the emulsions and before the coating of them. As the case may be, if desired, they may also be added thereto during or before the chemical ripening of the emulsions.

Precisely, the polymers may be added at any stage during the process of forming silver halide emulsion grains, for example, during the addition of silver salt solutions or after the addition of silver salt solution and before the start of the chemical ripening, or during chemical ripening.

Where the polymers are desired to be incorporated into non-light-sensitive auxiliary layers (hydrophilic colloid layers), they may be added to the coating compositions at any stage during and after the formation of the coating compositions.

It is preferred that the compound represented by formula (A) and the polymer having the repeating units represented by formula (I) are incorporated into the same layer in the photographic material.

The color photographic material of the present invention may contain various color couplers which are described hereinbelow. As a cyan coupler, a phenolic cyan coupler having a phenylureido group at its 2-position and a carbonamido group at its 5-position is preferably used.

Although its mechanism is not clear, the combination of the present invention and the phenolic cyan coupler results in further inhibition of the latensification especially under low-humidity conditions while the lowering of the sensitivity of the photographic material is small when the material is stored under high-humidity conditions before its exposure. Thus, the stability of the photographic material of the present invention containing the phenolic cyan coupler is extremely good during its storage.

The phenolic cyan coupler having a phenylureido group at its 2-position and a carbonamido group at its 5-position is preferably represented by the following general formula (B):

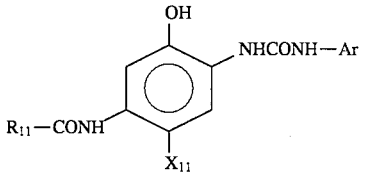

(B)

wherein $R_{11}$ represents an aliphatic group, an aromatic group or a heterocyclic group; Ar represents an aromatic group; and $X_{11}$ represents a hydrogen atom or a group capable of being split off from the coupler when the coupler is reacted with an oxidation product of an aromatic primary amine developing agent.

The aliphatic group as referred to herein means an aliphatic hydrocarbon residue (the same shall apply hereunder), including, for example, linear, branched or cyclic alkyl, alkenyl and alkynyl groups which may be either substituted or unsubstituted. The aromatic group means a substituted or unsubstituted aryl group, and this may be in the form of a condensed ring. The heterocyclic group means a substituted or unsubstituted, mono-cyclic or condensed-cyclic heterocyclic group.

$R_{11}$ is preferably an aliphatic group having from 1 to 36 carbon atoms, an aromatic group having from 6 to 36 carbon atoms, or a heterocyclic group having from 2 to 36 carbon atoms. It is more preferably a tertiary alkyl group having from 4 to 36 carbon atoms, or a group of the following general formula ($B_1$) having from 7 to 36 carbon atoms:

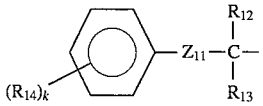

($B_1$)

wherein $R_{12}$ and $R_{13}$ may be the same or different and each represents a hydrogen atom, an aliphatic group having from 1 to 30 carbon atoms, or an aromatic group having from 6 to 30 carbon atoms; $R_{14}$ represents a monovalent group; $Z_{11}$ represents —O—, —S—, —SO— or —$SO_2$—; k represents an integer of from 0 to 5, and when k is a plural number, then plural $R_{14}$'s may be the same or different.

Preferably, $R_{12}$ and $R_{13}$ each are a linear or branched alkyl group having from 1 to 18 carbon atoms, $R_{14}$ is a halogen atom, an aliphatic group, an aliphatic-oxy group, a carbonamido group, a sulfonamido group, a carboxyl group, a sulfo group, a cyano group, a hydroxyl group, a carbamoyl group, a sulfamoyl group, an aliphatic oxy-carbonyl group or an aromatic oxy-sulfonyl group, and $Z_{11}$ is —O—. $R_{14}$ preferably has from 0 to 30 carbon atoms, and k is preferably from 1 to 3.

Ar represents a substituted or unsubstituted aryl group, and this may be in the form of a condensed ring. Typical examples of substituents for Ar include a halogen atom, a cyano group, a nitro group, a trifluoromethyl group, —$COOR_{15}$, —$COR_{15}$, —$SO_2OR_{15}$, —$NHCOR_{15}$, —$CONR_{15}R_{16}$, —$SO_2NR_{15}R_{16}$, —$OR_{15}$, —$NR_{15}(COR_{16})$, —$SO_2R_{17}$, —$SOR_{17}$, —$OCOR_{17}$ and —$NR_{15}(SO_2R_{17})$. $R_{15}$ and $R_{16}$ may be the same or different and each represents a hydrogen atom, an aliphatic group, an aromatic group or a heterocyclic group; and $R_{17}$ represents an aliphatic group, an aromatic group or a heterocyclic group. Ar has from 6 to 30 carbon atoms, and it is preferably a phenyl group having the above-described substituent(s).

$X_{11}$ represents a hydrogen atom or a coupling-split-off group (including coupling-split-off atoms—the same shall apply hereunder). Specific examples of coupling-split-off groups for $X_{11}$ include a halogen atom, —$OR_{18}$, —$SR_{18}$, —$OCOR_{18}$, —$NHCOR_{18}$, —$NHCOSR_{18}$, —OCO—$OR_{18}$, —$OCONHR_{18}$, an aromatic azo group having from 6 to 30 carbon atoms, and a heterocyclic group having from 1 to 30 carbon atoms and bonded to the coupling-active position of the coupler via its nitrogen atom (e.g., succinimido, phthalimido, hydantoinyl, pyrazolyl, 2-benzotriazolyl). $R_{18}$ represents an aliphatic group having from 1 to 30 carbon atoms, an aromatic group having from 6 to 30 carbon atoms, or a heterocyclic group having from 2 to 30 carbon atoms.

The aliphatic group in formula (B) may be a saturated or unsaturated, substituted or unsubstituted, linear, branched or cyclic one, as described above. Specific examples of the group include methyl, ethyl, butyl, cyclohexyl, allyl, propargyl, methoxyethyl, n-decyl, n-dodecyl, n-hexadecyl, trifluoromethyl, heptafluoropropyl, dodecyloxypropyl, 2,4-di-tert-amylphenoxypropyl, and 2,4-di-tert-amylphenoxybutyl groups.

The aromatic group may also be a substituted or unsubstituted one. Specific examples of the group include phenyl, tolyl, 2-tetradecyloxyphenyl, pentafluorophenyl, 2-chloro-5-dodecyloxycarbonylphenyl, 4-chlorophenyl, 4-cyanophenyl, and 4-hydroxyphenyl groups.

The heterocyclic group may also be a substituted or unsubstituted one. Specific examples of the group include 2-pyridyl, 4-pyridyl, 2-furyl, 4-thienyl, and quinolinyl groups.

Examples of preferred substituents in formula (B) are mentioned below.

$R_{11}$ is preferably a 1-(2,4-di-tert-amylphenoxy)amyl group, a 1-(2,4-di-tert-amylphenoxy)heptyl group or a t-butyl group.

Ar is especially preferably a 4-cyanophenyl group, a 4-alkylsulfonamidophenyl group (e.g., 4-methanesulfonamidophenyl, 4-propanesulfonamidophenyl, 4-butanesulfonamidophenyl), a 4-trifluoromethylphenyl group, or a halogen-substituted phenyl group (e.g., 4-fluorophenyl, 4-chlorophenyl, 4-chloro-3-cyanophenyl, 3,4-dichlorophenyl, 2,4,5-trichlorophenyl).

$X_{11}$ is preferably a hydrogen atom, a halogen atom or —$OR_{18}$, and $R_{18}$ is preferably a carboxyl group, a sulfo group, an alkoxycarbonyl group, a carbamoyl group, a sulfamoyl group, an alkoxysulfonyl group, an acyl group, an alkylsulfonyl group, an arylsulfonyl group, an alkylsulfinyl group, an arylsulfinyl group, a phosphono group or a phosphonoyl group. $R_{18}$ is especially preferably represented by the following general formula ($B_2$):

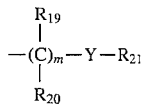

($B_2$)

wherein $R_{19}$ and $R_{20}$ each represents a hydrogen atom or a monovalent group; Y represents —CO—, —SO—, —$SO_2$—, or —$POR_{22}$—; $R_{21}$ and $R_{22}$ each represents a hydroxyl group, an alkyl group, an aryl group, an alkoxy group, an alkenyloxy group, an aryloxy group, or a substituted or unsubstituted amino group; and m represents an integer of from 1 to 6.

In formula ($B_2$), where $R_{19}$ and/or $R_{20}$ is a monovalent group, they each is preferably an alkyl group (e.g., methyl, ethyl, n-butyl, ethoxycarbonylmethyl, benzyl, n-decyl, n-dodecyl), an aryl group (e.g., phenyl, 4-chlorophenyl, 4-methoxyphenyl), an acyl group (e.g., acetyl, decanoyl, benzoyl, pivaloyl), or a carbamoyl group (e.g., N-ethylcarbamoyl, N-phenylcarbamoyl). More preferably, $R_{19}$ and $R_{20}$ each is a hydrogen atom, an alkyl group or an aryl group. In formula ($B_2$), Y is preferably —CO— or —$SO_2$—, more preferably —CO—. In formula ($B_2$), $R_{21}$ is preferably an alkyl group, an alkoxy group, an alkenyloxy group, an aryloxy group, or a substituted or unsubstituted amino group. More preferably, it is an alkoxy group. In formula ($B_2$), m is preferably an integer of from 1 to 3, more preferably 1.

$R_{13}$ is most preferably represented by the following general formula ($B_3$):

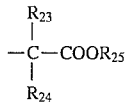

($B_3$)

wherein $R_{23}$ and $R_{24}$ each represents a hydrogen atom, or a substituted or unsubstituted alkyl or aryl group; and $R_{25}$ represents a substituted or unsubstituted alkyl, alkenyl or aryl group.

The couplers of formula (B) may form dimers, oligomers or higher polymers where the coupler units of formula (B) are bonded to each ocher at the group of $R_{11}$, Ar or $X_{11}$ via a divalent or higher polyvalent group. To such polymers, the definitions for the number of the carbon atoms constituting the above-described substituents do not apply.

Where the couplers of formula (B) are polymers, they are typically homopolymers or copolymers containing addition-polymerizing ethylenic unsaturated compounds (cyan-coloring monomers) having a cyan dye-forming coupler residue.

Specific examples of the compounds of formula (B) are indicated below, which, however, are not limitative.

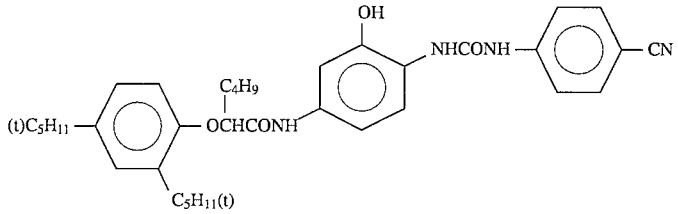

(B-1)

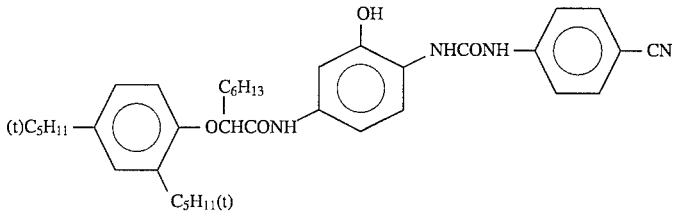

(B-2)

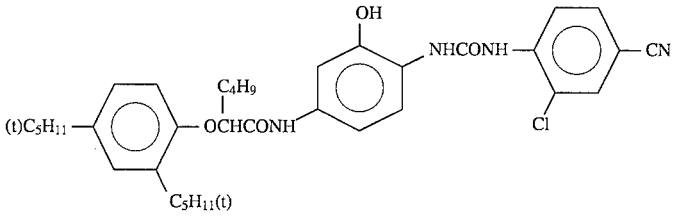

(B-3)

-continued
(B-4)
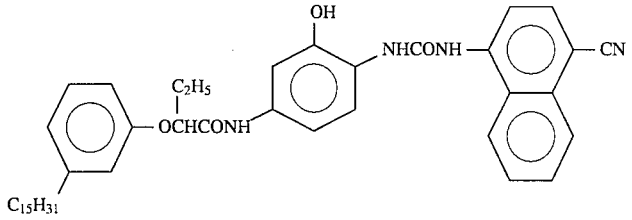
(B-5)
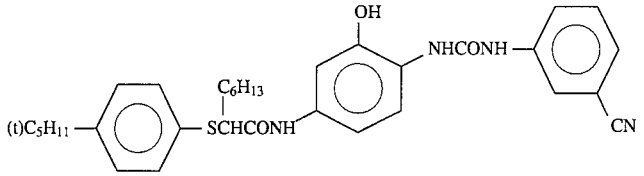
(B-6)
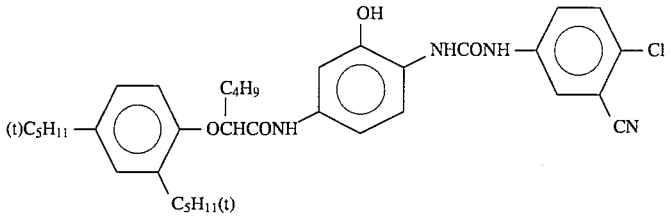
(B-7)
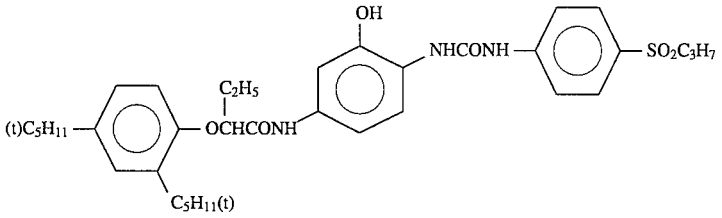
(B-8)
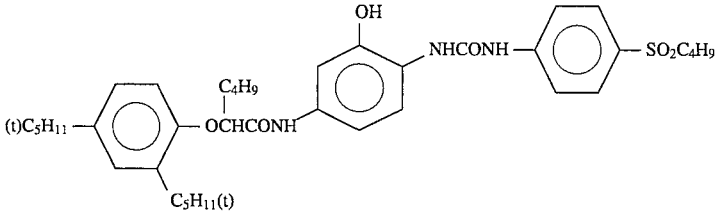
(B-9)
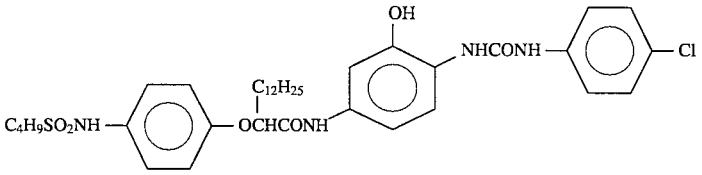
(B-10)
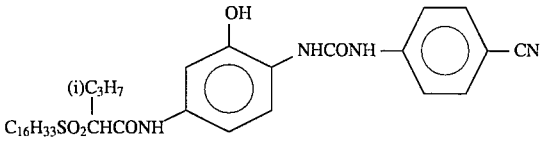
(B-11)
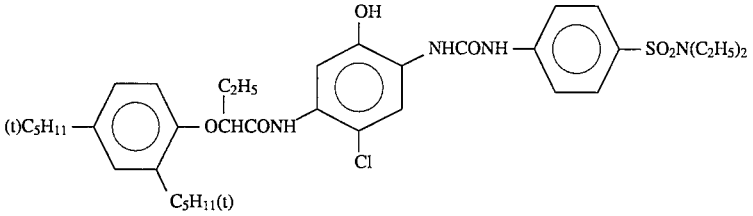

-continued
(B-12)
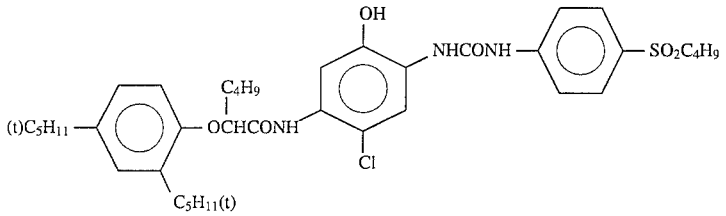
(B-13)
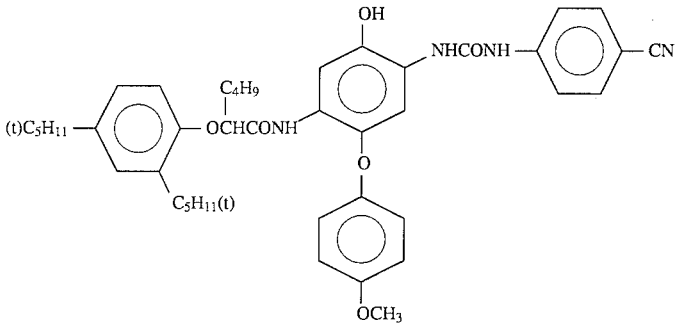
(B-14)
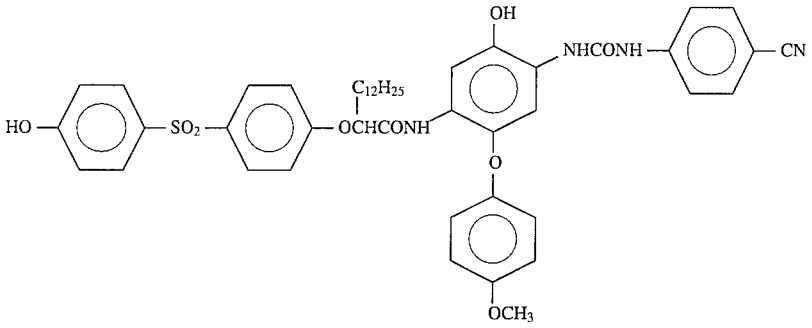
(B-15)
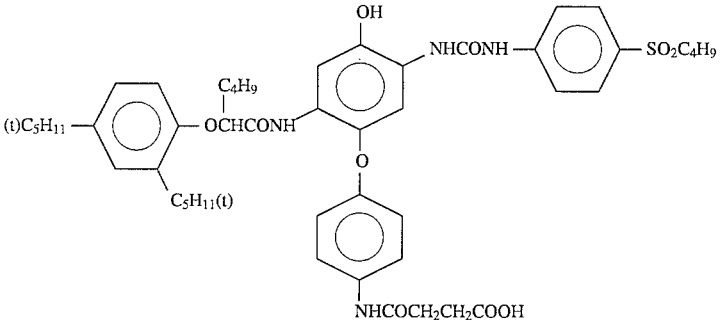
(B-16)
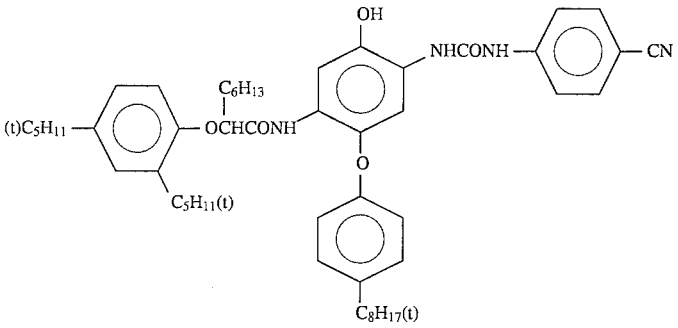

-continued
(B-17)
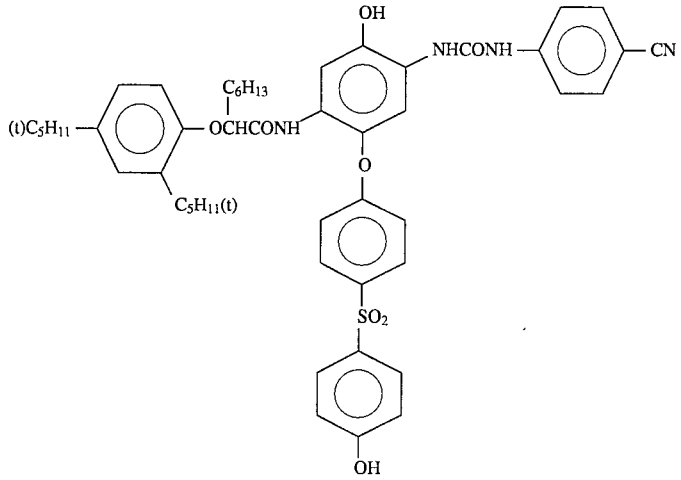
(B-18)
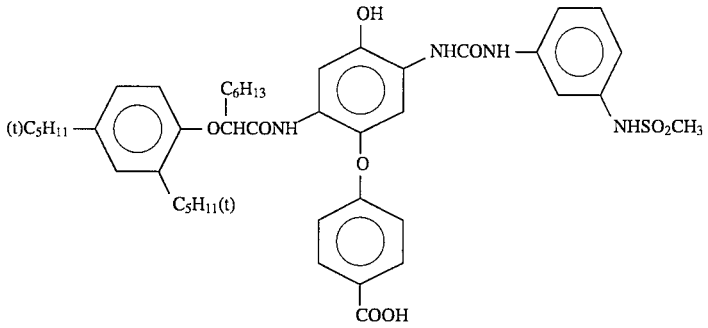
(B-19)
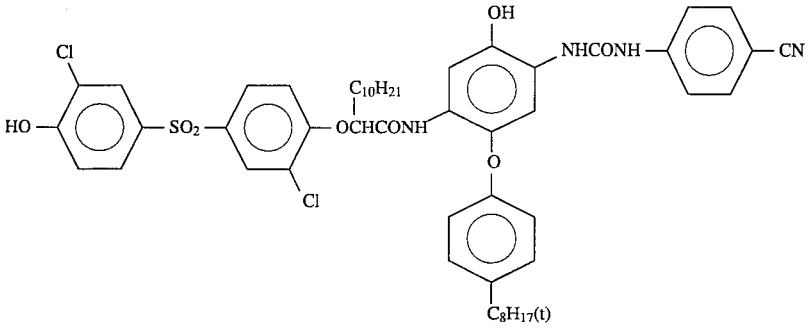
(B-20)
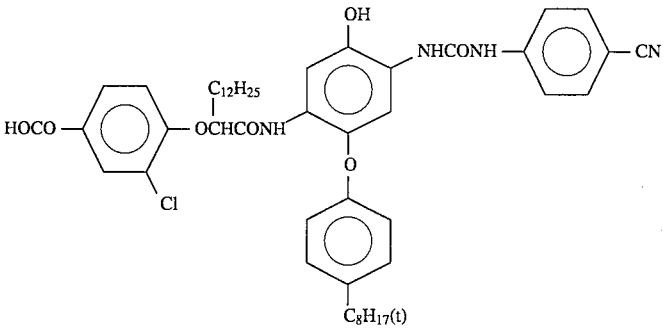

-continued
(B-21)
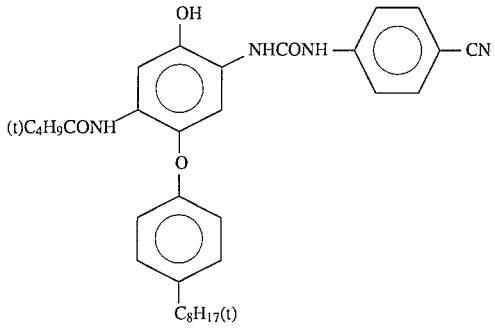
(B-22)
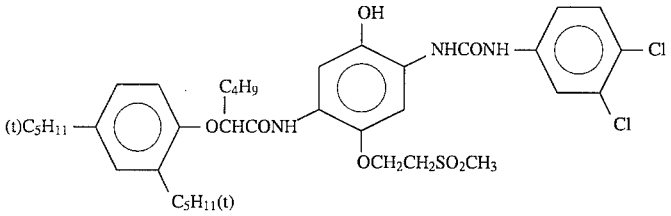
(B-23)
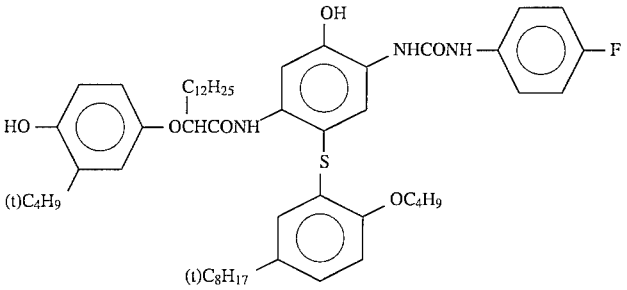
(B-24)
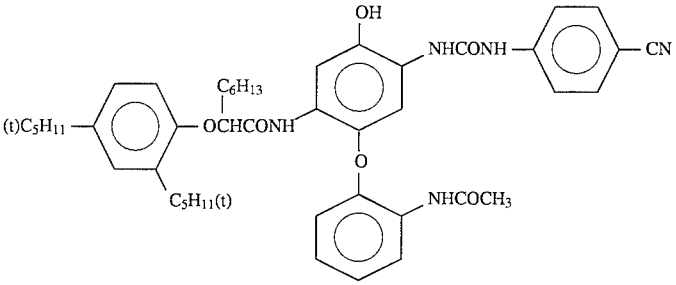
(B-25)
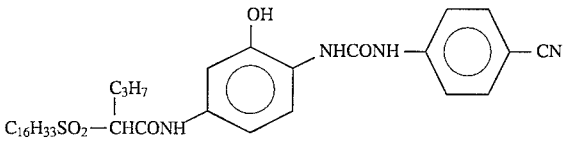
(B-26)
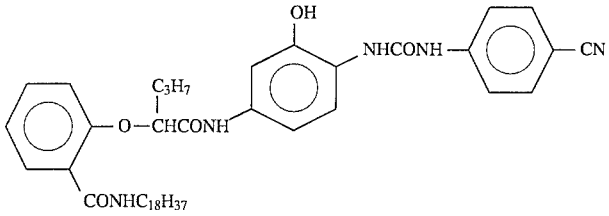

-continued

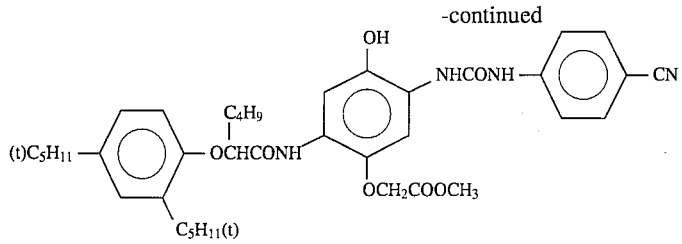

(B-27)

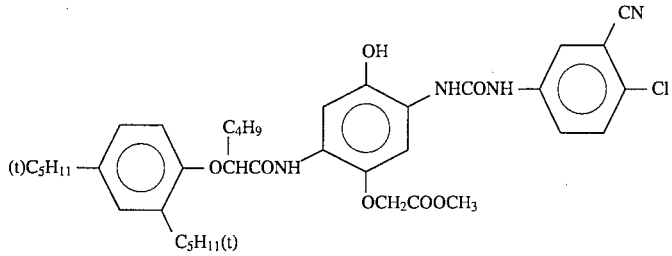

(B-28)

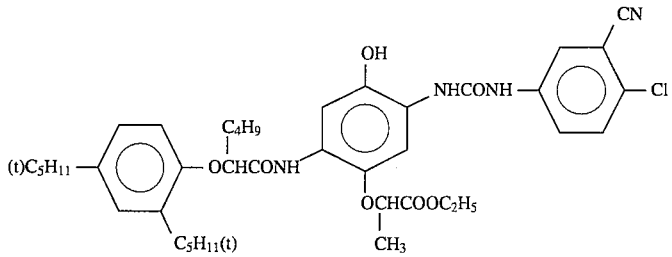

(B-29)

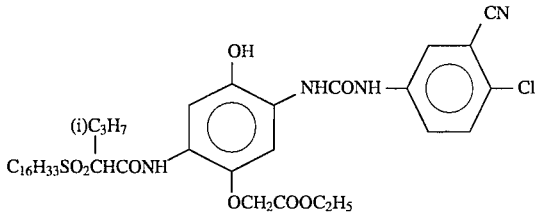

(B-30)

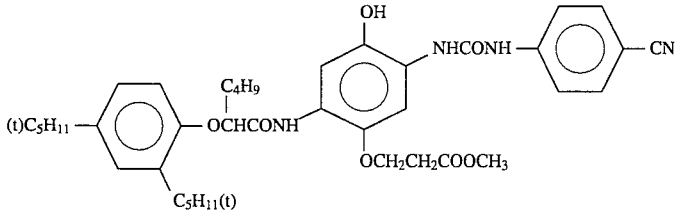

(B-31)

The couplers of formula (B) may be produced according to the methods described in U.S. Pat. Nos. 4,333,999, 4,427,767, JP-A 57-204543, 57-204544, 57-204545, 59-198455, 60-35731, 60-37557, 61-42658, 61-75351.

The amount of the high boiling point organic solvent to be added to the material preferably at most 1.0 g per gram of the coupler of formula (B). If it exceeds 1.0 g, the sharpness of the photographic material tends to lower. More preferably, the amount of the solvent to be used is 0.50 g or less, more preferably 0.25 g or less, per gram of the coupler of formula (B), and it may be 0 (zero) gram. The amount of the cyan coupler of formula (B) to be added to the photographic material of the present invention is generally from $1.0\times10^{-5}$ mol/m$^2$ of the material to $3.0\times10^{-3}$ mol/m$^2$, preferably from $1.0\times10^{-3}$ to $1.5\times10^{-3}$ mol/m$^2$.

Where the photographic material of the present invention is a multi-layered silver halide color photographic material, the cyan coupler of formula (B) may be added to any layer. However, it is preferably added to the red-sensitive layer so as to efficiently attain the effects of the invention. Where a color-sensitive layer having the same color sensitivity is composed of plural silver halide emulsion layers, the cyan coupler is preferably added to the low-sensitivity emulsion layer. It is also preferable that the compound of formula (A) is incorporated into the same layer as that containing the cyan coupler.

In the present invention, it is preferred that the silver halide grains in at least negative silver halide emulsion layer have been subjected to reduction sensitization. The compound of formula (A) is preferably incorporated into this emulsion layer.

The reduction sensitization to be applied to the grains will be described below.

The process for producing and coating silver halide emulsions is essentially composed of a step of forming the grains, a step of desalting, a step of chemically sensitizing and a step of coating the emulsions. The step of forming the grains is composed of nucleation, ripening and growing the grains. These steps are not always conducted in a determined order but the order of the steps may be reversed or the steps may be repeated. The reduction sensitization may be effected basically in any of these steps. For instance, it may be effected in any stage during nucleation which is the initial stage for formation of grains, during physical ripening or growth of the grains or before or after chemical sensitization of the grains. Where the grains are subjected to chemical sensitization along with gold sensitization, it is preferred that the reduction sensitization is effected prior to the chemical sensitization in order to prevent the emulsions from being unfavorably fogged. The best is to effect the reduction sensitization during the growth of silver halide grains. The wording "to effect the reduction sensitization during the growth of silver halide grains" as referred to herein includes both the process of subjecting silver halide grains to reduction sensitization while the grains are growing due to physical ripening or due to addition of water-soluble silver salts and water-soluble alkali halides and the process of subjecting silver halide grains to reduction sensitization while the growth of the grains is temporarily stopped and thereafter further growing the thus-sensitized grains.

To carry out the reduction sensitization according to the present invention, any of a process of adding a known reducing agent to silver halide emulsions, a process of growing or ripening silver halide grains under a so-called silver-ripening condition at a low pAg of from 1 to 7 and a process of growing or ripening silver halide grains under a so-called high-pH condition at a high pH of from 8 to 11 may be used. If desired, two or more of these processes may be employed together.

The process of adding a reduction-sensitizing agent is preferred, since the level of reduction sensitization may be delicately controlled according to the process.

Examples of conventionally known reduction-sensitizing agents include stannous salts, amines, polyamines, hydrazine derivatives, formamidinesulfinic acids, silane compounds, borane compounds, ascorbic acids and their derivatives, etc. Anyone or more may be chosen from among these known compounds for use in the present invention. As the reduction-sensitizing agents for use in the present invention, preferred are stannous chloride, thiourea dioxide, dimethylamineborane, ascorbic acid and their derivatives. The amount of the reduction-sensitizing agent to be added must be determined depending on the conditions for producing emulsions. In general, it is suitable from $10^{-7}$ to $10^{-1}$ mol per mol of the silver halide.

The reduction-sensitizing agent may be dissolved in a solvent such as water, alcohols, glycols, ketones, esters, amides, etc., and the resulting solution may be added to a system for production of silver halide grains during the formation thereof or before or after the chemical sensitization thereof. It may be added to silver halide emulsions in any stage in the process of forming them. Especially preferably, however, it is added thereto during the growth of the silver halide grains. It may be previously added to the reaction container, but preferably it is added thereto in a suitable stage during the formation of the grains. If desired, the reduction-sensitizing agent may be previously added to aqueous solutions of water-soluble silver salts or aqueous solutions of water-soluble alkali halides, and these solutions are reacted to form silver halide grains. It is also recommended to add a solution of the reduction-sensitizing agent several times intermittently to emulsions during the growth of the grains or to continuously add it for a long period of time during the same.

More preferably, it is desired that the reduction sensitization is essentially applied to the inside of each silver halide grain while too many reduction-sensitized nuclei are made not to exist near the surface of the grain, in order that the photographic material containing the grains is not fogged and that it may have satisfactory stability during storage.

For instance, silver halide grains may be subjected to reduction sensitization during the growth thereof, as mentioned above, whereby the inside of each grain may be essentially sensitized by the reduction sensitization. In order that too many reduction-sensitized nuclei are made not to exist near the surfaces of the thus reduction-sensitized silver halide grains, the following means may be employable.

1. The reduction sensitization is not conducted in the latter half stage where silver halide grains are growing.
2. After the formation of silver halide grains, the reduction-sensitized nuclei near the surface of each grain are reduced or preferably removed.

More preferably, the surfaces of the grains are treated with a silver-oxidizing agent.

More precisely, for the means 1, the reduction-sensitizing agent added is completely consumed before the intermediate stage during the formation of the grains while the reduction-sensitizing agent that has still remained in the intermediate stage during the formation of the grains is inactivated by oxidation or the like; or the latter half stage for the formation of the grains is conducted at a high pAg and a low pH so as to inactivate the substantially remaining reduction-sensitizing agent; or when the ripening of the grains is effected by silver ripening or high-pH ripening, the latter half stage for the formation of the grains is conducted at a high pAg or a low pH.

For the means 2, effectively employable are a process of ripening the grains at a high pAg or a low pH and a process of ripening the grains in the presence of a silver-oxidizing agent. As the silver-oxidizing agent, any known one may be used.

Of the two means, preferred is the means 2 of oxidizing the surfaces of the silver halide grains.

For this purpose, especially preferred is a process of adding at least one compound of the following general formulae (XI) to (XIII) to the system for the formation of silver halide grains. If desired, these compounds may also be used effectively for oxidizing the reduction-sensitized nuclei after the formation of the grains. Surprisingly, even when the compounds are added to silver halide grains in an intermediate stage during the growth of the grains to be subjected to reduction sensitization, the grains may be subjected to the intended reduction sensitization extremely effectively under determined favorable conditions while the photographic material containing the thus-sensitized grains is retarded from fogging and the material may have satisfactory stability during storage.

$$R—SO_2S—M \quad (XI)$$

$$R—SO_2S—R^1 \quad (XII)$$

$$R—SO_2S—Lm—SSO_2—R^2 \quad (XIII)$$

In these formulae, R, $R^1$ and $R^2$ may be the same or different and each represents an aliphatic group, an aromatic group or a heterocyclic group; M represents a cation; L represents a divalent linking group; and m is 0 or 1. The compounds of formulae (XI) to (XIII) may be in the form of polymers having repeating units of the divalent group derived from the compound of any of formulae (XI) to (XIII). If possible, any two or more of R, $R^1$, $R^2$ and L may be bonded to each other to form ring(s).

The thiosulfonic acid compounds of formulae (XI), (XII) and (XIII) will be explained in more detail. The aliphatic group for R, $R^1$ and $R^2$ is a saturated or unsaturated, linear, branched or cyclic aliphatic hydrocarbon group and is preferably an alkyl group having from 1 to 22 carbon atoms or an alkenyl or alkynyl group having from 2 to 22 carbon atoms. The aliphatic group may have substituent(s). The alkyl group includes, for example, methyl, ethyl, propyl, butyl, pentyl, hexyl, octyl, 2-ethylhexyl, decyl, dodecyl, hexadecyl, octadecyl, cyclohexyl, isopropyl and t-butyl groups.

The alkenyl group includes, for example, allyl and butenyl groups.

The alkynyl group includes, for example, propargyl and butynyl groups.

The aromatic group for R, $R^1$ and $R^2$ is a mono-cyclic or condensed-cyclic aromatic group, preferably having from 6 to 20 carbon atoms. It includes, for example, phenyl and naphthyl groups. It may optionally be substituted.

The heterocyclic group for R, $R^1$ and $R^2$ is a 3-membered to 15-membered, preferably 3-membered to 6-membered, heterocyclic group having at least one hetero atom chosen from among nitrogen, oxygen, sulfur, selenium and tellurium atoms and having at least one carbon atom. Examples of heterocyclic ring include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole and thiadiazole rings.

As the substituents for R, $R^1$ and $R^2$, for example, mentioned are an alkyl group (e.g., methyl, ethyl, hexyl), an alkoxy group (e.g., methoxy, ethoxy, octyloxy), an aryl group (e.g., phenyl, naphthyl, tolyl), a hydroxyl group, a halogen atom (e.g., fluorine, chlorine, bromine, iodine), an aryloxy group (e.g., phenoxy), an alkylthio group (e.g., methylthio, butylthio), an arylthio group (e.g., phenylthio), an acyl group (e.g., acetyl, propionyl, butyryl, valeryl), a sulfonyl group (e.g., methylsulfonyl, phenylsulfonyl), an acylamino group (e.g., acetylamino, benzoylamino), a sulfonylamino group (e.g., methanesulfonylamino, benzenesulfonylamino), an acyloxy group (e.g., acetoxy, benzoxy), a carboxyl group, a cyano group, a sulfo group, an amino group, $—SO_2SM$ (where M is a monovalent cation), and $—SO_2R^1$.

The divalent linking group of L is an atom or an atomic group containing at least one atom chosen from among C, N, S and O. It includes, for example, an alkylene group, an alkenylene group, an alkynylene group, an arylene group, —O—, —S—, —NH—, —CO—, $—SO_2—$, and combinations of them.

L is preferably a divalent aliphatic group or a divalent aromatic group. The divalent aliphatic group of L includes, for example, $$\text{-}(CH_2)_n\text{-} \quad (n=1\text{–}12),\ -CH_2-CH=CH-CH_2-,$$

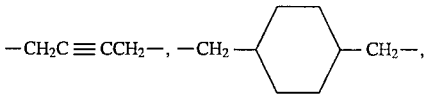

a xylylene group, etc. The divalent aromatic group of L includes, for example, a phenylene group and a naphthylene group.

These substituents may optionally be substituted by substituent(s) such as those mentioned hereinabove.

M is preferably a metal ion or an organic cation. The metal ion includes, for example, lithium ion, sodium ion and potassium ion. The organic cation includes, for example, an ammonium ion (e.g., ammonium, tetramethylammonium, tetrabutylammonium), a phosphonium ion (e.g., tetraphenylphosphonium) and a guanidyl group.

When the compounds represented by formulae (XI) to (XIII) are polymers, examples of repeating units there of include the followings.

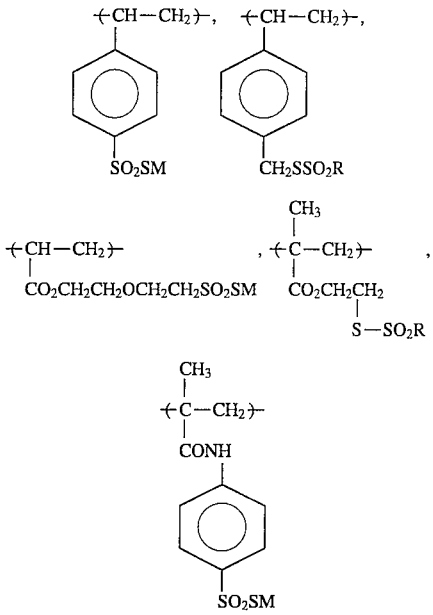

wherein M has the same meanings as in formula (XI) wherein M has the same meanings as in formula (XI).

These polymers may be either homopolymers or copolymers containing other comonomers.

Specific examples of the compounds of formulae (XI), (XII) and (XIII) are mentioned below, which, however, are not limitative.

$CH_2SO_2SNa$ (1-1)
$C_2H_5SO_2SNa$ (1-2)
$C_3H_7SO_2SK$ (1-3)
$C_4H_9SO_2SLi$ (1-4)
$C_6H_{13}SO_2SNa$ (1-5)
$C_8H_{17}SO_2SNa$ (1-6)

$CH_3(CH_2)_3CH(C_2H_5)CH_2SO_2S.NH_4$ (1-7)

$C_{10}H_{21}SO_2SNa$ (1-8)
$C_{12}H_{25}SO_2SNa$ (1-9)
$C_{16}H_{33}SO_2SNa$ (1-10)

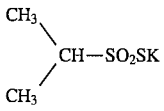
(1-11)

$t\text{-}C_4H_9SO_2SNa$ (1-12)
$CH_3OCH_2CH_2SO_2S.Na$ (1-13)

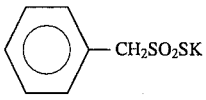
(1-14)

$CH_2=CHCH_2SO_2Na$ (1-15)

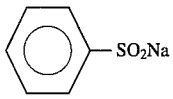
(1-16)

-continued
(1-17)
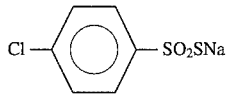
(1-18)
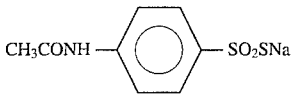
(1-19)
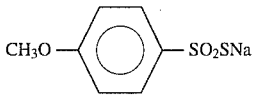
(1-20)
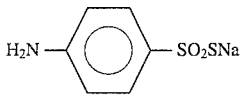
(1-21)
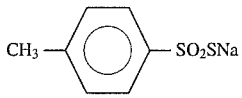
(1-22)
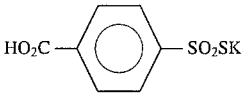
(1-23)
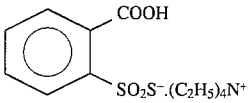
(1-24)
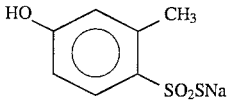
(1-25)
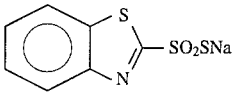
(1-26)
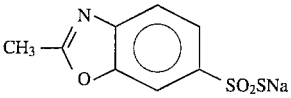
(1-27)
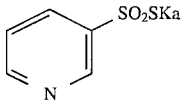
(1-28)
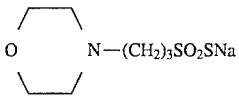
$KSSO_2(CH_2)_2SO_2SK$ (1-29)
$NaSSO_2(CH_2)_4SO_2SNa$ (1-30)
$NaSSO_2(CH_2)_4S(CH_2)_4SO_2SNa$ (1-31)
(1-32)
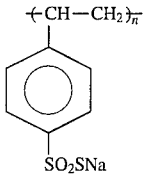
-continued
(1-33)
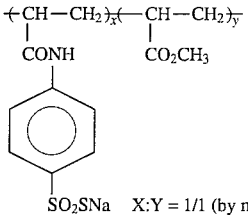
X:Y = 1/1 (by mol)
$C_2H_5SO_2S-CH_3$ (2-1)
$C_8H_{17}SO_2SCH_2CH_3$ (2-2)
(2-3)
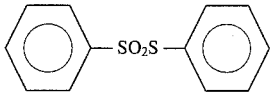
(2-4)
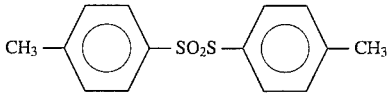
$C_2H_5SO_2SCH_2CH_2CN$ (2-5)
(2-6)
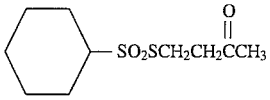
(2-7)
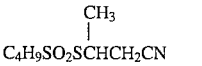
(2-8)
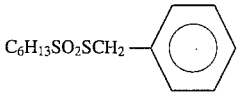
(2-9)
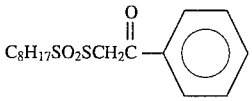
(2-10)
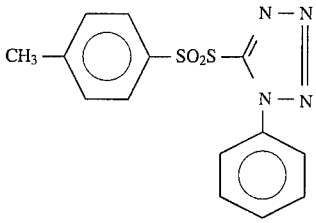
(2-11)
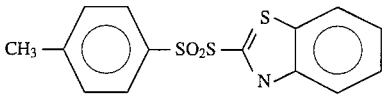
(2-12)
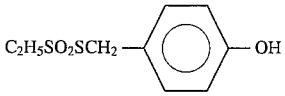
(2-13)
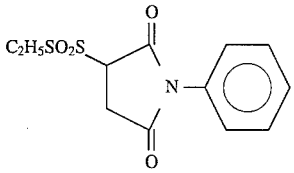
(2-14)
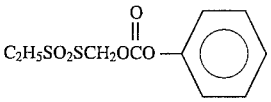

-continued

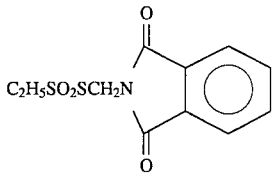

(2-15)

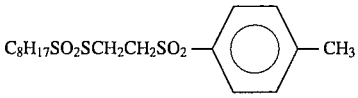

(2-16)

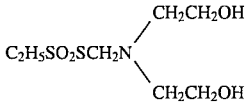

(2-17)

$C_2H_5SO_2SCH_2CH_2CH_2CH_2OH$ (2-18)

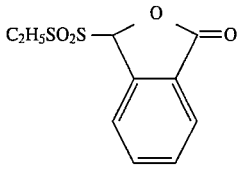

(2-19)

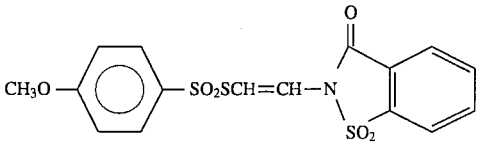

(2-20)

$CH_3SSO_2(CH_2)_4SO_2SCH_3$ (2-21)

$CH_3SSO_2(CH_2)_2SO_2SCH_3$ (2-22)

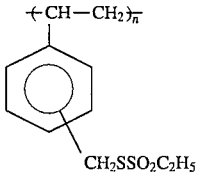

(2-23)

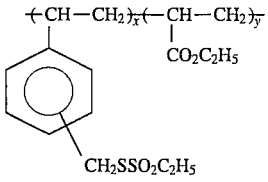

(2-24)

x:y = 2/1 (molar ratio)

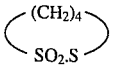

(2-25)

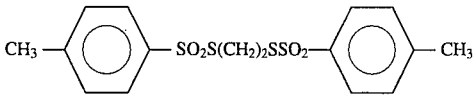

(3-1)

$C_2H_5SO_2SCH_2CH_2SO_2CH_2CH_2SSO_2C_2H_5$ (3-2)

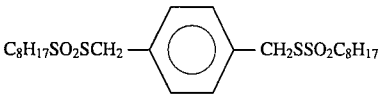

(3-3)

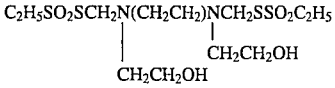

(3-4)

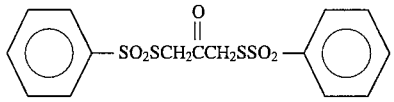

(3-5)

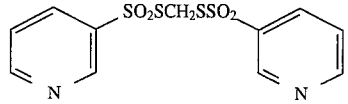

(3-6)

$C_2H_5SO_2SSSO_2C_2H_5$ (3-7)

$(n)C_3H_7SO_2SSSO_2C_3H_7(n)$ (3-8)

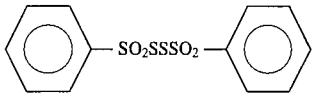

(3-9)

The compounds of formulae (XI), (XII) and (XIII) may easily be produced by the methods described or referred to in JP-A 54-1019, British Patent 972,211, *Journal of Organic Chemistry*, Vol. 53, p. 396 (1988), and *Chemical Abstracts*, Vol. 59, 9776e.

The compound of formula (XI), (XII) or (XIII) is preferably added to silver halide grains in an amount of from $10^{-7}$ to $10^{-1}$ mol per mol of the silver halide. More preferably, the amount of the compound to be added is from $10^{-6}$ to $10^{-2}$ mol/mol of Ag, especially preferably from $10^{-5}$ to $10^{-3}$ mol/mol of Ag.

To add the compounds of formulae (XI) to (XIII) to silver halide emulsions during the step of forming the emulsions, any ordinary method which is generally employed for adding additives to photographic emulsions may be used. For instance, when the compounds are soluble in water, they are formed into their aqueous solutions having suitable concentrations. When insoluble or hardly soluble in water, they are dissolved in suitable water-miscible organic solvents which do not have any bad influence on photographic properties selected from among alcohols, glycols, ketones, esters and amides, to form their solutions.

The compounds of formulae (XI) to (XIII) may be added in any stage of production of a silver halide emulsion i.e., during formation of silver halide grains, or before or after the chemical sensitization thereof. Preferably, they are added into the emulsion before or during reduction sensitization of the emulsions. Especially preferably, they are added thereto during the growth of the emulsion grains.

They may be previously added to the reaction container, but preferably they are added thereto in a suitable stage during the formation of silver halide grains. If desired, the compound of any of formulae (XI) to (XIII) may be previously added to aqueous solutions of water-soluble silver salts or aqueous solutions of water-soluble alkali halides, and these solutions are reacted to form silver halide grains. It may also be employed to add a solution of the compound of any of formulae (XI) to (XIII) several times intermittently to emulsions during the growth of the grains or to continuously add it for a long period of time during the same.

Of the compounds of formulae (XI) to (XIII), most preferred are those of formula (XI) for use in the present invention.

Various techniques and inorganic and organic materials which are employable in carrying out the present invention are described in European Patent 436,938A2 and other patents mentioned below.

1. Layer Structures EP 436,938A2, from page 146, line 34 to page 147, line 25
2. Silver Halide Emulsions EP 436,938A2, from page 147, line 26 to page 148, line 12

3. Yellow Couplers EP 436,938A2, from page 137, line 35 to page 146, line 33, and page 149, lines 21 to 23
4. Magenta Couplers EP 436,938A2, page 149, lines 24 to 28; EP 421,453A1, from page 3, line 5 to page 25, line 55
5. Cyan Couplers EP 436,938A2, page 149, lines 29 to 33; EP 432,804A2, from page 3, line 28 to page 40, line 2
6. Polymer Couplers EP 436,938A2, page 149, lines 34 to 38; EP 435,334A2, from page 113, line 39 to page 123, line 37
7. Colored Couplers EP 436,938A2, from page 53, line 42 to page 137, line 34, and page 149, lines 39 to 45
8. Other Functional Couplers EP 436,938A2, from page 7, line 1 to page 53, line 41, and from page 149, line 46 to page 150, line 3; EP 435,334A2, from page 3, line 1 to page 29, line 50
9. Antiseptics, Antifungals EP 436,938A2, page 150, lines 25 to 28
10. Formalin Scavengers EP 436,938A2, page 149, lines 15 to 17
11. Other Additives EP 436,938A2, page 153, lines 38 to 47; EP 421,453A1, from page 75, line 21 to page 84, lines 56, and from page 27, line 40 to page 37, line 40
12. Dispersing Methods EP 436,938A2, page 150, lines 4 to 24
13. Supports EP 436,938A2, page 150, lines 32 to 34
14. Thickness of Films, Properties of films EP 436,938A2, page 150, lines 35 to 49
15. Color Development Steps EP 436,938A2, from page 150, line 50 to page 151, line 47
16. Desilvering Steps EP 436,938A2, from page 151, line 48 to page 152, line 53
17. Automatic Developing Machines EP 436,938A2, from page 152, line 54 to page 153, line 2
18. Rinsing and Stabilizing Steps EP 436,938A2, page 153, lines 3 to 37

EXAMPLE 1

An emulsion layer and a protective layer each having the composition indicated below were coated on a cellulose triacetate film support coated with a subbing layer, to prepare Sample No. 101.

<Emulsion Layer>

Emulsion: An emulsion of tabular silver halide (AgBrI) grains having a mean sphere-corresponding diameter of 0.8 μm, a mean aspect ratio of 6 and a silver iodide content of 4 mol %, where tabular grains account for 90% or more of the projected area of all the grains, were prepared in such a way that thiourea dioxide was added thereto in an amount of $3\times10^{-6}$ mol per mol of the silver halide at the time when 60% by volume of the grains were formed and that Compound (1–2) of the above-mentioned formula (XI) was added thereto in an amount of $5\times10^{-5}$ mol per mol of the silver halide at the time when 95% by volume of the grains were formed, whereby the inside of each tabular grain was subjected to reduction sensitization. The grains formed were washed with water and dispersed in gelatin, and a sensitizing dye indicated below, potassium thiocyanate, chloroauric acid, sodium thiosulfate and Selenium Sensitizing Agent 21 were added to the emulsion, by which the emulsion was subjected to apectral sensitization and chemical sensitization to have an optimum sensitivity for exposure of 1/100 second. The emulsion thus prepared is referred to as Emulsion I.

Selenium Sensitizing Agent 21

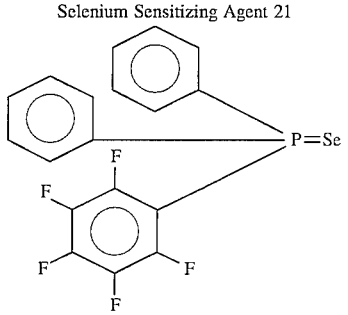

The composition of Emulsion I. was as follows:

| | |
|---|---|
| Emulsion I | $1.60\times10^{-2}$ mol/m² as Ag |
| Sensitizing Dye 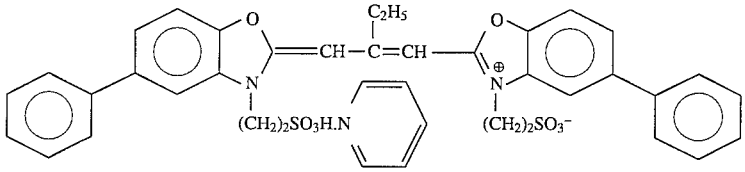 | $6\times10^{-4}$ mol per mol of Ag |
| Coupler C-1 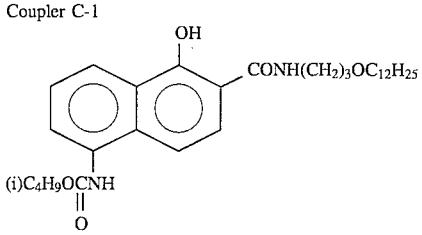 | 0.70 g/m² |
| Tricresyl Phosphate | 0.30 g/m² |
| Gelatin | 2.30 g/m² |

-continued

| | |
|---|---|
| <Protective Layer> | |
| 2,4-Dichlorotriazine-6-hydroxy-s-triazine Sodium Salt | 0.10 g/m$^2$ |
| Gelatin | 1.80 g/m$^2$ |

Sample Nos. 102 to 115 were prepared in the same manner as Sample No. 101 above, except that the compound of formula (A) shown in Table 1 was added to the emulsion layer in an amount of $1.5\times10^{-2}$ mol per mol of silver therein, that the polymer having the repeating units of formula (I) also shown in Table 1 was added to the same in an amount of 30 mg/m$^2$ and that Coupler C-1 was replaced by the phenolic cyan coupler having a phenylureido group in its 2-position and a carbonamido group in its 5-position also shown in Table 1.

TABLE 1

| Sample No. | | Compound of Formula (A) | Compound of formula (I) | Coupler |
|---|---|---|---|---|
| 101 | comparative sample | — | — | C-1 0.70 g/m$^2$ |
| 102 | comparative sample | (A-7) | — | C-1 0.70 g/m$^2$ |
| 103 | comparative sample | — | (12) | C-1 0.70 g/m$^2$ |
| 104 | sample of the invention | (A-7) | (12) | C-1 0.70 g/m$^2$ |
| 105 | sample of the invention | (A-7) | (1) | C-1 0.70 g/m$^2$ |
| 106 | sample of the invention | (A-3) | (1) | C-1 0.70 g/m$^2$ |
| 107 | comparative sample | — | — | B-6 0.65 g/m$^2$ |
| 108 | comparative sample | (A-7) | — | B-6 0.65 g/m$^2$ |
| 109 | comparative sample | — | (12) | B-6 0.65 g/m$^2$ |
| 110 | sample of the invention | (A-7) | (12) | B-6 0.65 g/m$^2$ |
| 111 | sample of the invention | (A-7) | (1) | B-6 0.65 g/m$^2$ |
| 112 | sample of the invention | (A-3) | (1) | B-6 0.65 g/m$^2$ |
| 113 | sample of the invention | (A-14) | (1) | B-6 0.65 g/m$^2$ |
| 114 | sample of the invention | (A-28) | (1) | B-6 0.65 g/m$^2$ |
| 115 | sample of the invention | (A-36) | (1) | B-6 0.65 g/m$^2$ |

These samples were sensitometrically exposed and then color-developed according to the process indecated below.

The density of each of the thus-processed samples was measured through a red filter The development was effected at 38° C. according to the process indecated below.

1. Color Development 1 min 45 sec
2. Bleaching 6 min 30 sec
3. Rinsing with water 3 min 15 sec
4. Fixation 6 min 30 sec
5. Rinsing with water 3 min 15 sec
6. Stabilization 3 min 15 sec Processing solutions used in these steps are indecated below.

<Color Developer>
Sodium Nitrilotriacetate 1.4 g
Sodium Sulfite 4.0 g
Sodium Carbonate 30.0 g
Potassium Bromide 1.4 g
Hydroxylamine Sulfate 2.4 g
4-(N-ethyl-N-β-hydroxyethylamino)-2-methylaniline Sulfate 4.5 g
Water to make one liter
<Bleaching Solution>
Sodium Ethylenediaminetetraacetato/$Fe^{+++}$ Trihydrate 100.0 g
Disodium Ethylenediaminetetraacetate 10.0 g
3-Mercapto-1,2,4-triazole 0.08 g
Ammonium Bromide 140.0 g
Ammonium Nitrate 30.0 g
Aqueous Ammonia (27%) 6.5 ml
Water to make one liter
pH 6.0
<Fixer>
Disodium Ethylenediaminetetraacetate 0.5 g
Ammonium Sulfite 20.0 g
Ammonium Thiosulfate Aqueous Solution (700 g/liter) 290.0 ml
Water to make one liter
pH 6.7
<Stabilizer>
Sodium P-toluenesulfinate 0.03 g
Polyoxyethylene P-mononononylphenyl Ether (mean degree of polymerization 10) 0.2 g
Disodium Ethylenediaminetetraacetate 0.05 g
1,2,4-Triazole 1.3 g
1,4-Bis (1,2,4-triazol-1-ylmethyl)piperazine 0.75 g
Water to make one liter
pH 8.5

The sensitometrical exposure of the samples was conducted by ordinary wedge exposure for 1/100 second.

As the light source for the exposure, used was SC-50 Filter (made by Fuji Photo Film Co.) that had been adjusted to give a color temperature of 4800° C. with a filter.

"Fog" and "sensitivity" as referred to hereunder have the following means:

Fog: This means the minimum optical density on the characteristic curve. The larger, the worse.

Sensitivity: This means the reciprocal of the amount of exposure (real value) for giving an optical density equaling to the minimum optical density plus 0.2 on the characteristic curve. This has been represented herein as a relative value to the sensitivity of Sample No. 101 of being 100. The larger, the better.

Next, the samples were treated in the manner mentioned below, so as to evaluate the storability of the latent image formed. Each sample was wedgewise exposed in the same manner as above, then stored at a temperature of 50° C. and a relative humidity of 30% for 14 days, and thereafter color-developed by the same process as above. The data of the samples were compared with those of the corresponding samples that had been developed immediately after exposure. The difference in the fog was referred to as the representative of the fog increased due to storage, and the difference in the sensitivity as the representative of the latensification or the latent image fading.

In order to evaluate the raw-film storability of the samples before exposure, the samples were stored at a temperature of 40° C. and a relative humidity of 85% for 14 days, then exposed and color-developed in the same manner as above. The data of the samples were compared with those of the corresponding samples after coating. Like the evaluation of the properties of latent images mentioned above, the difference in the fog and the difference in the sensitivity were referred to as the representatives.

The results obtained are shown in Table 2.

formula (I) preventing the increase in the fog during storage brought about the synergistic effect of the two.

Comparing Sample Nos. 105, 106 and 111 to 115 with each other, it is understood that the compounds of formula (A-II) are especially superior to the others of formula (A).

Comparing Sample No. 104 with Sample No. 105 and comparing Sample No. 110 with Sample No. 111, it is understood that the polymers composed of only the repeating units of formula (I) are superior to the other copolymers having the repeating units of formula (I).

Comparing the relation between Sample No. 101 and Sample Nos. 104 to 106 with that between Sample No. 107 and Sample Nos. 110 to 115, it is understood that the samples containing the phenolic cyan coupler having a phenylureido group at its 2-position and a carbonamido group at its 5-position are especially excellent in that the lowering of the sensitivity of the unexposed photographic

TABLE 2

| | | Properties of Sample | | Storability of Exposed Sample | | Storability of Sample Before Exposure | |
|---|---|---|---|---|---|---|---|
| | | Immediately After Coating | | Variation in | Variation in | Variation in | Variation in |
| Sample No. | | Fog | Sensitivity | Fog | Sensitivity | Fog | Sensitivity |
| 101 | comparative sample | 0.13 | 0.0 (standard) | 0.20 | +0.25 | 0.12 | −0.20 |
| 102 | comparative sample | 0.13 | +0.01 | 0.18 | +0.10 | 0.12 | −0.19 |
| 103 | comparative sample | 0.11 | −0.05 | 0.20 | +0.24 | 0.06 | −0.16 |
| 104 | sample of the invention | 0.11 | ±0 | 0.10 | +0.03 | 0.04 | −0.14 |
| 105 | sample of the invention | 0.10 | −0.01 | 0.08 | +0.01 | 0.03 | −0.13 |
| 106 | sample of the invention | 0.11 | −0.03 | 0.13 | +0.07 | 0.04 | −0.14 |
| 107 | comparative sample | 0.12 | +0.01 | 0.18 | +0.23 | 0.12 | −0.21 |
| 108 | comparative sample | 0.12 | +0.03 | 0.15 | +0.09 | 0.11 | −0.20 |
| 109 | comparative sample | 0.10 | −0.05 | 0.18 | +0.22 | 0.06 | −0.15 |
| 110 | sample of the invention | 0.10 | +0.05 | 0.08 | +0.02 | 0.03 | −0.07 |
| 111 | sample of the invention | 0.09 | +0.04 | 0.08 | +0.01 | 0.02 | −0.04 |
| 112 | sample of the invention | 0.10 | +0.03 | 0.11 | +0.05 | 0.03 | −0.06 |
| 113 | sample of the invention | 0.10 | +0.03 | 0.12 | +0.11 | 0.04 | −0.07 |
| 114 | sample of the invention | 0.08 | +0.05 | 0.07 | ±0 | 0.03 | −0.05 |
| 115 | sample of the invention | 0.10 | +0.04 | 0.09 | +0.04 | 0.03 | −0.07 |

From the results in Table 2, the effects of the present invention are obvious.

Specifically, comparing Sample Nos. 101 to 103 with Sample Nos. 104 to 106 and comparing Sample Nos. 107 to 109 with Sample Nos. 110 to 115, it is understood that the combination of the compound of formula (A) preventing the latensification and the polymer having the repeating units of material was less during storage, and the sensitivity of the photographic material immediately after coating was high.

EXAMPLE 2

This example is to demonstrate the difference between the compounds of JP-A 1-210948, which react with an oxidation product of a color developing agent without providing density to the image and which are used in conbination with a polymer having repeating units derived from a vinylpyrrolidone compound and having a mean molecular weight of not more than 30,000, and the compounds of formula (A) of the present invention.

Sample Nos. 201 and 202 were prepared in the same manner as Sample No. 101 in Example 1, except that the same molar amount of H-4 and P-8, respectively, were used in place of Compound (A-7). H-4 and P-8 are compounds of JP-A 210948 which react with an oxidation product of a color developing agent without providing density to the image density.

H-4

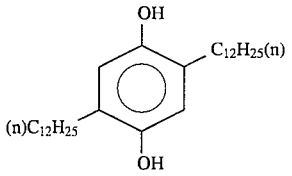

P-8

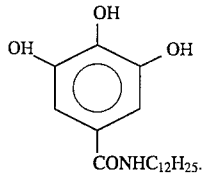

These samples were evaluated in the same manner as in Example 1, and the results obtained are shown in Table 3.

sample without lowering the sensitivity thereof (or rather with somewhat increasing the sensitivity thereof), whilst H-4 and P-8 obviously lowered the sensitivity of the samples and therefore these are unfavorable. In addition, although H-4 was somewhat effective in preventing the increase in fog during storage, it did not have at all an effect of retarding the latensification. On the other hand, P-8 was somewhat effective in retarding the latensification, but its effect of preventing the increase in fog during storage is small. From these facts, the difference between the present invention and the invention of JP-A 1-210948 is obvious.

EXAMPLE 3

Thick tabular silver iodobromide emulsion grains having a mean iodide content of 8.5 mol %, a mean sphere-corresponding diameter of 1.1 μm, a mean aspect ratio of 3.5 were formed, while the grains were subjected to reduction sensitization by anyone of the methods A to H mentioned below after 60% by volume of the grains had been formed. The emulsions were rinsed, dispersed, spectrally-sensitized and chemically sensitized in the same manner as in Example 1, and the compounds of the invention shown in Table 4 were added thereto. Using these emulsions, Sample Nos. 301 to 316 were prepared in the same manner as in Example 1. As the coupler, used was Coupler B-6.

TABLE 3

| | | Properties of Sample | | Storability of Exposed Sample | | Storability of Sample Before Exposure | |
|---|---|---|---|---|---|---|---|
| | | Immediately After Coating | | Variation in | Variation in | Variation in | Variation in |
| Sample No. | | Fog | Sensitivity | Fog | Sensitivity | Fog | Sensitivity |
| 107 | comparative sample | 0.12 | +0.01 | 0.18 | +0.23 | 0.12 | −0.21 |
| 110 | sample of the invention | 0.10 | +0.05 | 0.08 | +0.02 | 0.03 | −0.07 |
| 201 | comparative sample | 0.10 | −0.08 | 0.10 | +0.25 | 0.06 | −0.19 |
| 202 | comparative sample | 0.09 | −0.12 | 0.14 | +0.07 | 0.09 | −0.18 |

From Table 3, the difference between the present invention and JP-A 1-210948 is obvious. Specifically, Compound (A-7) of the present invention improved the storability of the

TABLE 4

| Sample No. | | Method of Reduction Sensitization | Compound of Formula (A) | Compound of Formula (I) |
|---|---|---|---|---|
| 301 | comparative sample | A | — | — |
| 302 | comparative sample | B | — | — |
| 303 | comparative sample | C | — | — |
| 304 | comparative sample | D | — | — |
| 305 | comparative sample | E | — | — |
| 306 | comparative sample | F | — | — |
| 307 | comparative sample | G | — | — |
| 308 | comparative sample | H | — | — |
| 309 | sample of the invention | A | A-7 | (1) |
| 310 | sample of the invention | B | A-7 | (1) |
| 311 | sample of the invention | C | A-7 | (1) |
| 312 | sample of the invention | D | A-7 | (1) |

TABLE 4-continued

| Sample No. | | Method of Reduction Sensitization | Compound of Formula (A) | Compound of Formula (I) |
|---|---|---|---|---|
| 313 | sample of the invention | E | A-7 | (1) |
| 314 | sample of the invention | F | A-7 | (1) |
| 315 | sample of the invention | G | A-7 | (1) |
| 316 | sample of the invention | H | A-7 | (1) |

Methods for Reduction Sensitization:
A: The grains were formed while pH was raised from 4.8 to 6.0 during the formation thereof.
B: The grains were formed while pAg was lowered from 8.2 to 7.0 during the formation thereof.
C: The grains were subjected to reduction sensitization during the formation thereof, by adding thiourea dioxide thereto in an amount of $4 \times 10^{-6}$ mol per mol of the silver halide.
D: The grains were subjected to reduction sensitization during the formation thereof, by adding tin chloride ($SnCl_2$) thereto in an amount of $6 \times 10^{-7}$ mol per mol of the silver halide.
E: The grains were subjected to reduction sensitization during the formation thereof, by adding L-ascorbic acid thereto in an amount of $1 \times 10^{-4}$ mol per mol of the silver halide.
F: The grains were subjected to reduction sensitization using thiourea dioxide in an amount of $3 \times 10^{-5}$ mol per mol of the silver halide at the time when 60% by volume of the grains had been formed and using Compound (1–2) in an amount of $9 \times 10^{-5}$ mol per mol of the silver halide after the formation of the grains.
G: The grains were subjected to reduction sensitization using thiourea dioxide in an amount of $3 \times 10^{-5}$ mol per mol of the silver halide at the time when 60% by volume of the grains had been formed and using Compound (1–2) in an amount of $7 \times 10^{-5}$ mol per mol of the silver halide at the time when 95% by volume of the grains had been formed.
H: The grains were not subjected to reduction sensitization during the formation thereof.

The samples were stored, exposed and developed in the same manner as in Example 1, and the properties of the processed samples were evaluated also in the same manner as in Example 1. The results obtained are shown in Table 5.

TABLE 5

| | | Properties of Sample | | Storability of Exposed Sample | | Storability of Sample Before Exposure | |
|---|---|---|---|---|---|---|---|
| | | Immediately After Coating | | Variation in | Variation in | Variation in | Variation in |
| Sample No. | | Fog | Sensitivity | Fog | Sensitivity | Fog | Sensitivity |
| 301 | comparative sample | 0.15 | +0.07 | 0.29 | +0.30 | 0.14 | −0.28 |
| 302 | comparative sample | 0.07 | +0.05 | 0.28 | +0.32 | 0.14 | −0.29 |
| 303 | comparative sample | 0.07 | +0.12 | 0.27 | +0.27 | 0.13 | −0.25 |
| 304 | comparative sample | 0.08 | +0.11 | 0.30 | +0.33 | 0.15 | −0.28 |
| 305 | comparative sample | 0.17 | +0.12 | 0.30 | +0.32 | 0.14 | −0.29 |
| 306 | comparative sample | 0.13 | +0.15 | 0.21 | +0.22 | 0.13 | −0.20 |
| 307 | comparative sample | 0.12 | +0.18 | 0.20 | +0.20 | 0.13 | −0.20 |
| 308 | comparative sample | 0.09 | 0.0 (standard) | 0.10 | +0.10 | 0.11 | −0.23 |
| 309 | sample of the invention | 0.15 | +0.10 | 0.12 | +0.12 | 0.07 | −0.12 |
| 310 | sample of the invention | 0.17 | +0.07 | 0.12 | +0.13 | 0.07 | −0.12 |
| 311 | sample of the invention | 0.16 | +0.14 | 0.11 | +0.08 | 0.06 | −0.09 |
| 312 | sample of the invention | 0.17 | +0.14 | 0.13 | +0.14 | 0.08 | −0.11 |
| 313 | sample of the invention | 0.17 | +0.15 | 0.13 | +0.15 | 0.08 | −0.12 |
| 314 | sample of the invention | 0.12 | +0.17 | 0.08 | +0.03 | 0.04 | −0.05 |
| 315 | sample of the invention | 0.12 | +0.20 | 0.07 | +0.01 | 0.02 | −0.05 |
| 316 | sample of the invention | 0.10 | +0.03 | 0.05 | −0.02 | 0.02 | −0.09 |

From Table 5, the effects of the present invention are obvious. Specifically, comparing Sample No. 301 with Sample No. 309, Sample No. 302 with Sample No. 310 . . . and Sample No. 308 with Sample No. 316, the same effects as those in Example 1 are verified.

In general, reduction sensitization of silver halide emulsions results in the increase in the sensitivity thereof while, however, it results in the increase in the fog thereof during storage and the increase in the latensification. The present invention has overcome the disadvantages. Comparing Sample Nos. 301 to 307 with Sample Nos. 309 to 315, it is noted that the stability of the latter samples of the present invention during storage was improved while the sensitivity of the same was increased.

Comparing Sample Nos. 309 to 313 with Sample Nos. 314 and 315, it is noted that the reduction sensitization of the inside of each silver halide grain combined with the oxidation of the surface thereof is especially preferred in carrying out the present invention.

EXAMPLE 4

Plural layers each having the composition mentioned below were coated on a subbing layer-coated cellulose triacetate support, to prepare a multi-layer color photographic material sample 401.

Compositions of Photographic Layers:

Essential components of constituting the photographic layers are grouped as follows:

ExC: Cyan Coupler

UV: Ultraviolet Absorbent

ExM: Magenta Coupler

HBS: High Boiling Point Organic Solvent

ExY Yellow Coupler

H: Gelatin Hardening Agent

ExS: Sensitizing Dye

The number for each component indicates the amount coated by way of a unit of $g/m^2$. The amount of silver halide coated is represented as the amount of silver therein coated. The amount of sensitizing dye coated is represented by way of a molar unit to mol of silver halide in the same layer.

Sample 401

First Layer (Anti-halation Layer)
Black Colloidal Silver 0.18 as Ag
Gelatin 1.60
ExM-1 0.11
ExF-1 $3.4\times10^{-4}$
HBS-1 0.16
Second Layer (Interlayer)
ExC-2 0.055
UV-1 0.011
UV-2 0.030
UV-3 0.053
HBS-1 0.05
HBS-2 0.020
Polyethyl Acrylate Latex $8.1\times10^{-2}$
Gelatin 0.75
Third Layer (Low-sensitivity Red-sensitive Emulsion Layer)
Emulsion A 0.46 as Ag
ExS-1 $5.0\times10^{-4}$
ExS-2 $1.8\times10^{-5}$
ExS-3 $5.0\times10^{-4}$
ExC-1 0.11
ExC-3 0.045
ExC-4 0.07
ExC-5 0.0050
ExC-7 0.001
ExC-8 0.010
HBS-1 0.090
Gelatin 0.87
Fourth Layer (Middle-sensitivity Red-sensitive Emulsion Layer)
Emulsion D 0.70 as Ag
ExS-1 $3.0\times10^{-4}$
ExS-2 $1.2\times10^{-5}$
ExS-3 $4.0\times10^{-4}$
ExC-1 0.13
ExC-2 0.055
ExC-4 0.085
ExC-5 0.007
ExC-8 0.009
HBS-1 0.11
Gelatin 0.70
Fifth Layer (High-sensitivity Red-sensitive Emulsion Layer)
Emulsion E 1.62 as Ag
ExS-1 $2.0\times10^{-4}$
ExS-2 $1.0\times10^{-5}$
ExS-3 $3.0\times10^{-4}$
ExC-1 0.125
ExC-3 0.040
ExC-6 0.010
ExC-8 0.014
HBS-1 0.22
HBS-2 0.10
Gelatin 1.60
Sixth Layer (Interlayer)
Cpd-1 0.07
HBS-1 0.04
Polyethyl Acrylate Latex 0.19
Gelatin 1.30
Seventh Layer (Low-sensitivity Green-sensitive Emulsion Layer)
Emulsion A 0.24 as Ag
Emulsion B 0.10 as Ag
Emulsion C 0.14 as Ag
ExS-4 $4.0\times10^{-5}$
ExS-5 $1.8\times10^{-4}$
ExS-6 $6.5\times10^{-4}$
ExM-1 0.005
ExM-2 0.30
ExM-3 0.09
ExY-1 0.015
HBS-1 0.26
HBS-3 0.006
Gelatin 0.80
Eighth Layer (Middle-sensitivity Green-sensitive Emulsion Layer)
Emulsion D 0.94 as Ag
ExS-4 $2.0\times10^{-5}$
ExS-5 $1.4\times10^{-4}$
ExS-6 $5.4\times10^{-4}$
ExM-2 0.16
ExM-3 0.045
ExY-1 0.008
ExY-5 0.030
HBS-1 0.14
HBS-3 $8.0\times10^{-3}$
Gelatin 0.90
Ninth Layer (High-sensitivity Green-sensitive Emulsion Layer)
Emulsion E 1.29 as Ag
ExS-4 $3.7\times10^{-5}$
ExS-5 $8.1\times10^{-5}$
ExS-6 $3.2\times10^{-4}$
ExC-1 0.011
ExM-1 0.016
ExM-4 0.046
ExM-5 0.023
Cpd-3 0.050

HBS-1 0.20
HBS-2 0.08
Polyethyl Acrylate Latex 0.26
Gelatin 1.57
Tenth Layer (Yellow Filter Layer)
Yellow Colloidal Silver 0.010 as Ag
Cpd-1 0.10
HBS-1 0.055
Gelatin 0.70

In addition, the respective layers contained any of W-1 through W-3, B-4, F-1 through F-17, and iron salt, lead salt, gold salt, platinum salt, iridium salt and rhodium salt, so as to have improved storability, processability, pressure resistance, fungicidal and bactericidal property, antistatic property and coatability.

TABLE 6

| AgBrI Emulsion | Mean AgI Content (mol %) | Mean Grain Size (μm) | Fluctuation Coefficient Relative to Grain Size (%) | Ratio of Diameter/-Thickness | Ratio of Silver Contents [core/interlayer/shell] (AgI content mol %) | | Structure and Shape of Grains |
|---|---|---|---|---|---|---|---|
| Emulsion A | 2.0 | 0.55 | 25 | 7 | — | | uniform structural tabular grains |
| Emulsion B | 9.0 | 0.63 | 25 | 6 | [12/59/29] | (0/11/8) | three-layer structural tabular grains |
| Emulsion C | 3.0 | 0.60 | 25 | 7 | [10/60/30] | (0/1/8) | three-layer structural tabular grains |
| Emulsion D | 4.1 | 0.80 | 18 | 6 | [14/56/30] | (0.2/3.3/7.5) | three-layer structural tabular grains |
| Emulsion E | 3.4 | 1.10 | 16 | 6 | [6/64/30] | (0.2/2.7/5.5) | three-layer structural tabular grains |
| Emulsion F | 13.6 | 1.75 | 26 | 3 | [1/2] | (41/0) | two-layer structural tabular grains |
| Emulsion G | 1.0 | 0.07 | 15 | 1 | — | | uniform structural fine grains |

Eleventh Layer (Low-sensitivity Blue-sensitive Emulsion Layer)
Emulsion A 0.25 as Ag
Emulsion C 0.25 as Ag
Emulsion D 0.10 as Ag
ExS-7 $8.0\times10^{-4}$
ExY-1 0.010
ExY-2 0.070
ExY-3 0.055
ExY-4 0.006
ExY-6 0.075
ExC-7 0.040
HBS-1 0.025
Gelatin 1.60
Twelfth Layer (High-sensitivity Blue-sensitive Emulsion Layer)
Emulsion F 1.30 as Ag
ExS-7 $3.0\times10^{-4}$
ExY-2 0.15
ExY-3 0.06
HBS-1 0.070
Gelatin 1.13
Thirteenth Layer (First Protective Layer)
UV-2 0.08
UV-3 0.11
UV-4 0.26
HBS-1 0.09
Gelatin 2.40
Fourteenth Layer (Second Protective Layer)
Emulsion G 0.10 as Ag
H-1 0.37
B-1 (diameter 1.7 μm) $5.0\times10^{-2}$
B-2 (diameter 1.7 μm) 0.10
B-3 0.10
S-1 0.20
Gelatin 0.75

In Table 6;

(1) Emulsions A to F were sensitized by reduction sensitization with thiourea dioxide and thiosulfonic acid, according to the example in JP-A 2-191938 (corresponding to U.S. Pat. No. 5,061,614), when the grains were prepared.

(2) Emulsions A to F were sensitized by gold sensitization, sulfur sensitization and selenium sensitization in the presence of the spectrally sensitizing dyes described in each color-sensitive layer and sodium thiocyanate, according to the example in JP-A 3-237450 (corresponding to EP 443,453A).

(3) In preparing the tabular grains, a low-molecular weight gelatin was used according to the example in JP-A 1-158426.

(4) Dislocation lines such as those described in JP-A 3-237450 were found in the tabular grains, when the grains were observed with a high-pressure electronic microscope.

ExC-1
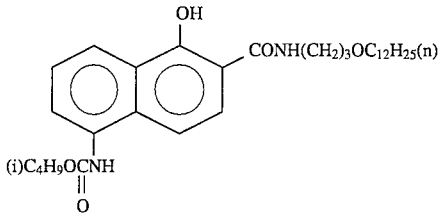
ExC-2
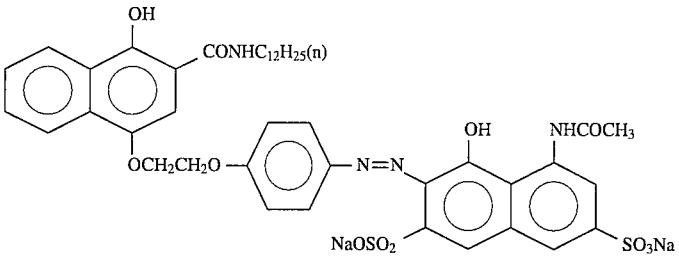
ExC-3
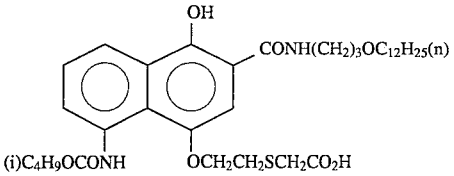
ExC-4
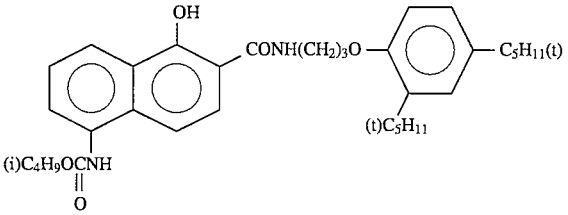
ExC-5
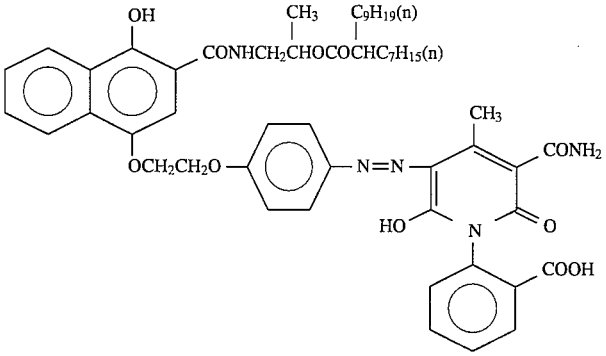
ExC-6
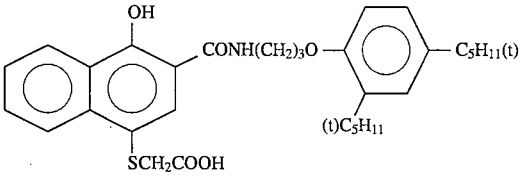

-continued
ExC-7
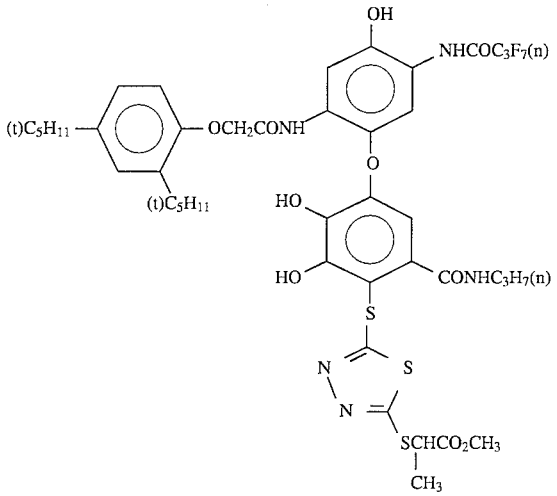
ExC-8
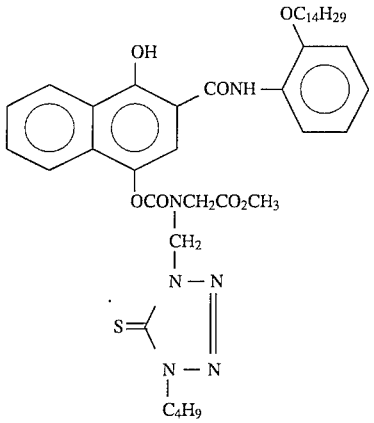
ExM-1
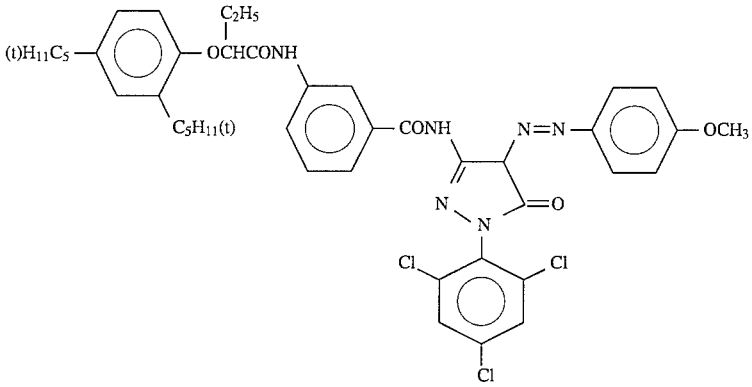

-continued
ExM-2
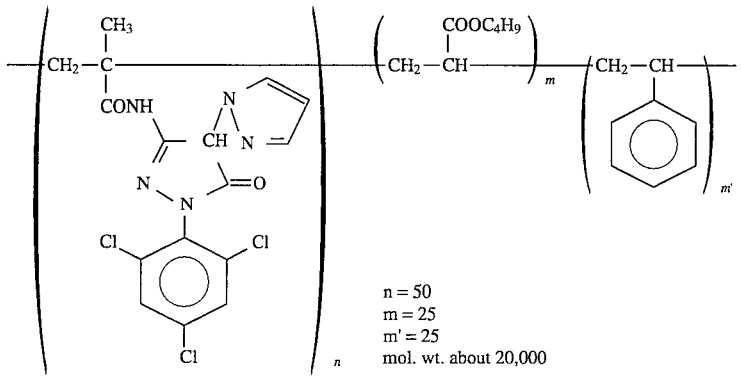
n = 50
m = 25
m' = 25
mol. wt. about 20,000
ExM-3
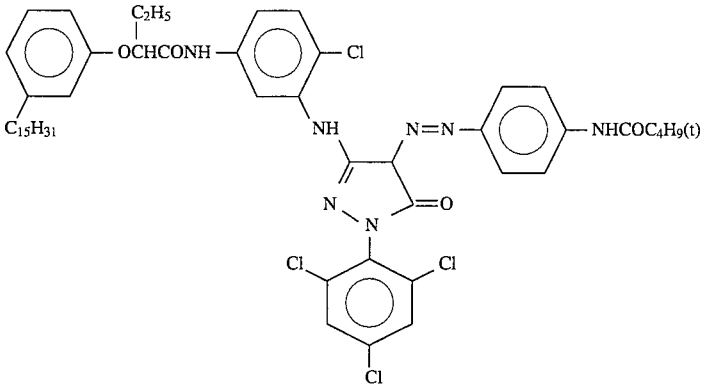
ExM-4
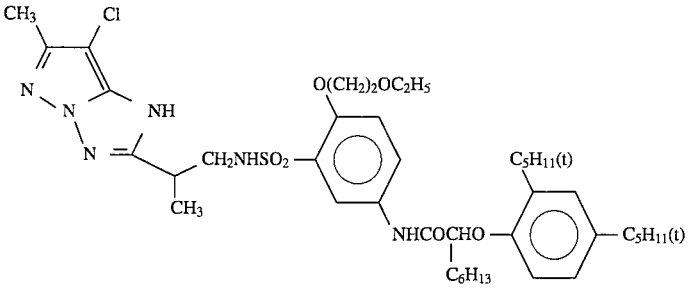
ExM-5
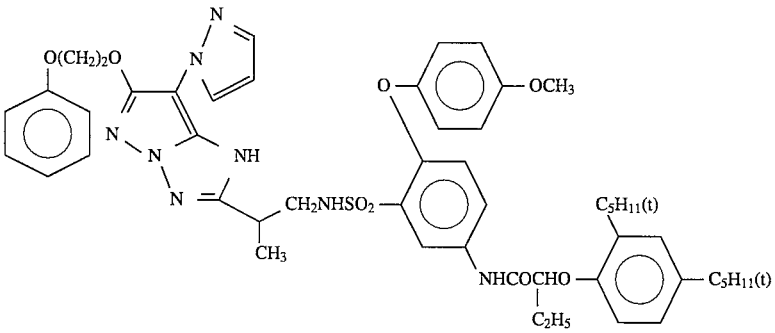

-continued
ExY-1
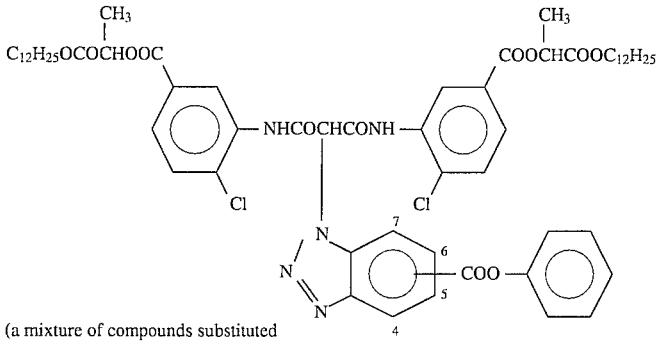
(a mixture of compounds substituted at 5- or 6-: the same hereinafter)
ExY-2
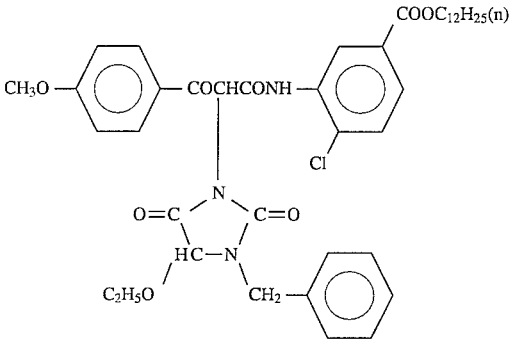
ExY-3
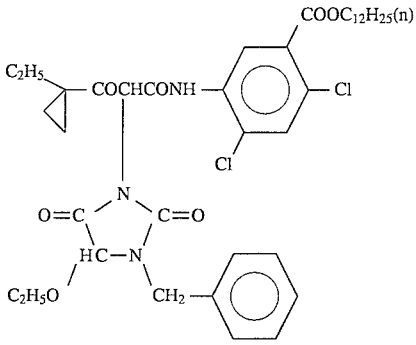
ExY-4
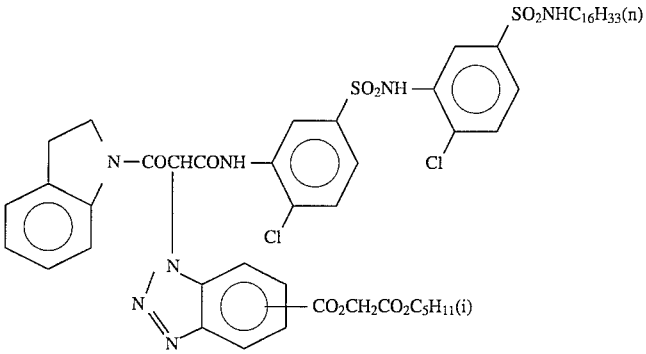
ExY-5
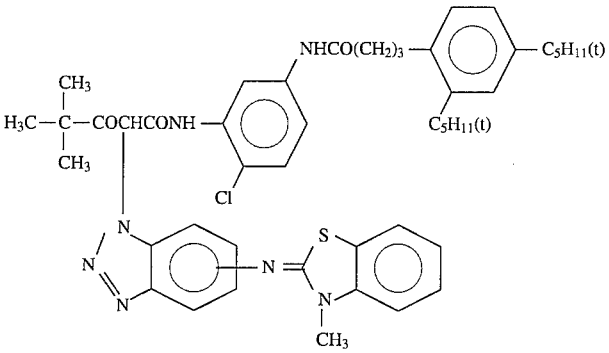

-continued
ExY-6
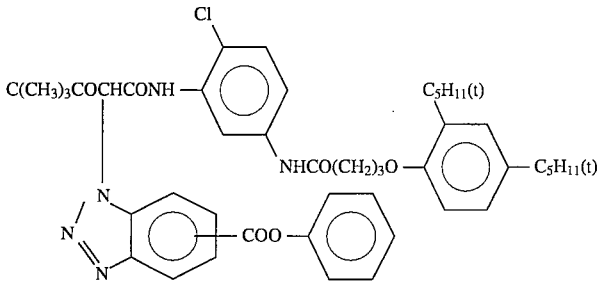
ExF-1
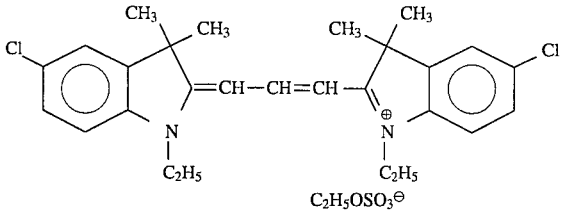
Cpd-1
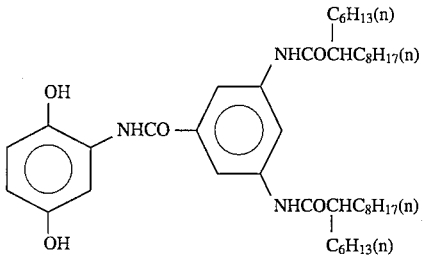
Cpd-3
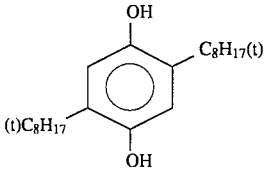
UV-1
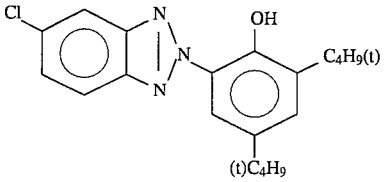
UV-2
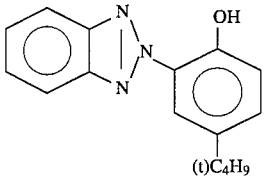
UV-3
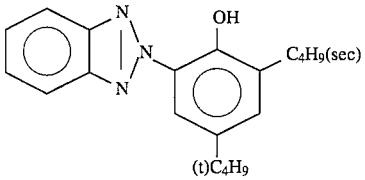
UV-4
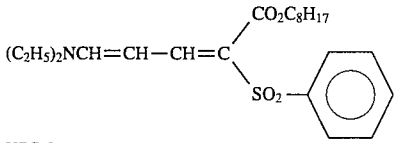
HBS-1
Tricresyl Phosphate
HBS-2
Di-n-butyl Phthalate
HBS-3
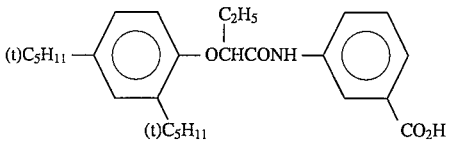
ExS-1
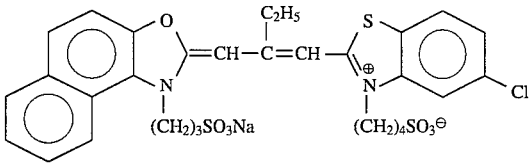

-continued
ExS-2
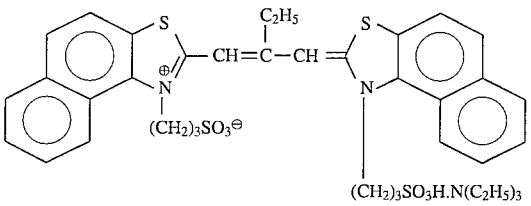
ExS-3
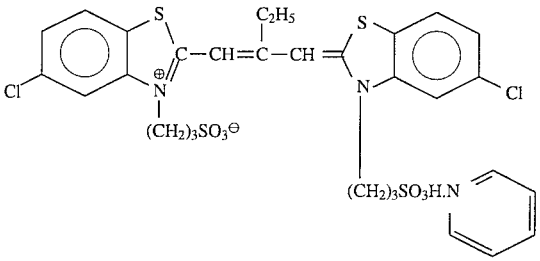
ExS-4
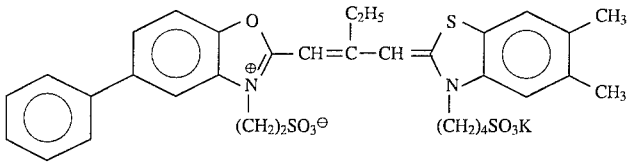
ExS-5
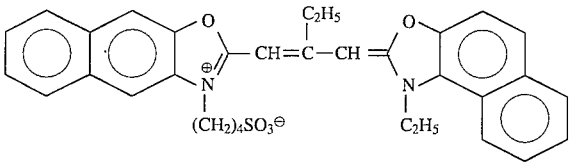
ExS-6
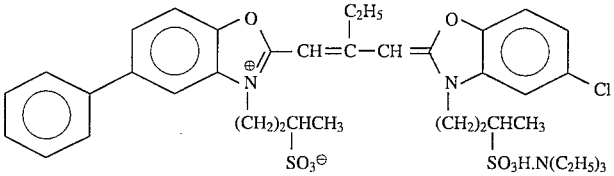
ExS-7
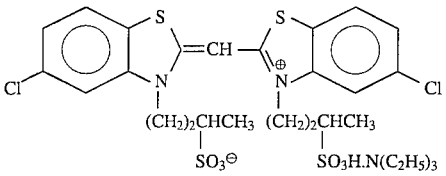
S-1
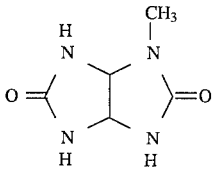
H-1
$CH_2{=}CH{-}SO_2{-}CH_2{-}CONH{-}CH_2$
$CH_2{=}CH{-}SO_2{-}CH_2{-}CONH{-}CH_2$
B-1
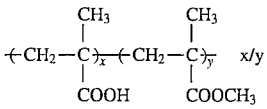
x/y = 10/90 (molar ratio)

B-2
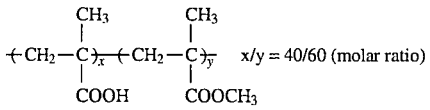
-continued
B-3
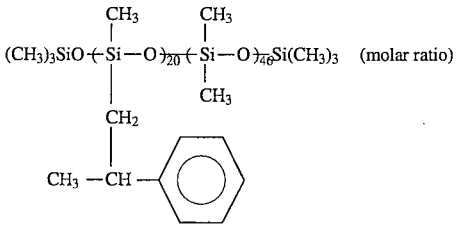
B-4
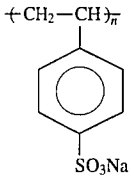
W-1
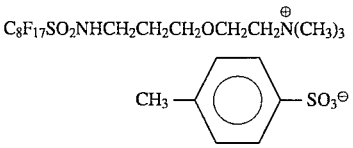
W-2
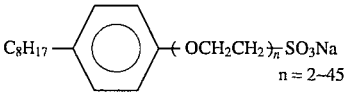
n = 2–45 (a mixture of n = 1, 2 and 3)
W-3
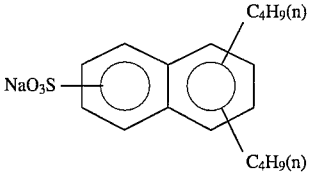
F-1
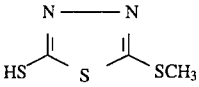
F-2
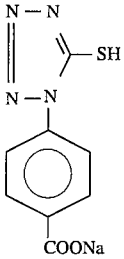
F-3
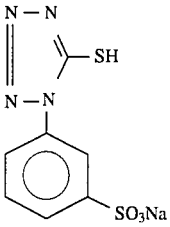
F-4
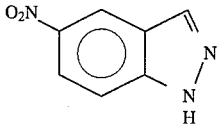
F-5
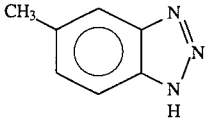
F-6
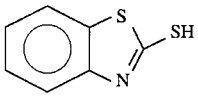

-continued

F-7

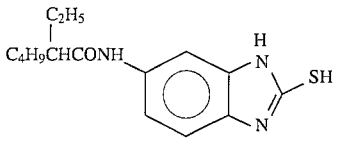

F-8

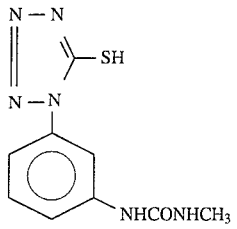

F-9

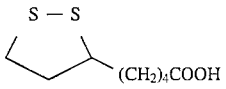

F-10

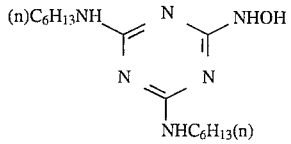

F-11

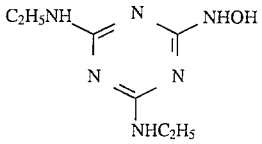

F-12

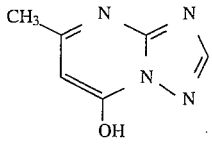

F-13

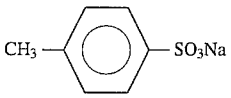

F-14

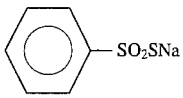

F-15

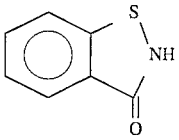

F-16

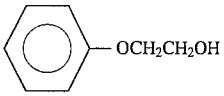

F-17

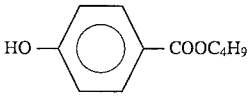

Sample Nos. 401 to 406 were prepared in the same manner as Sample No. 401, except that the compound of formula (A) of the invention was added to the third layer and the fourth layer each in an amount of $1\times10^{-2}$ mol and $1.8\times10^{-2}$ mol, respectively, per mol of silver therein and that the polymer having the repeating units of formula (I) was added to the third layer and the fourth layer each in an amount of 20 mg/m$^2$ and 40 mg/m$^2$, respectively, both as shown in Table 7.

Sample Nos. 407 to 412 were prepared in the same manner as Sample No. 401 to 406, respectively, except that Coupler ExC-1 and Coupler ExC-4 in the third layer and the fourth layer each were replaced by 0.85 molar times of Coupler B-6 (this is a phenolic cyan coupler having a phenylureido group at its 2-position and a carbonamido group at its 5-position).

TABLE 7

| Sample No. | | Compound of Formula (A) | Compound of formula (I) | Cyan Coupler B-6 |
|---|---|---|---|---|
| 401 | comparative sample | — | — | — |
| 402 | comparative sample | (A-7) | — | — |
| 403 | comparative sample | — | (12) | — |
| 404 | sample of the invention | (A-7) | — | — |
| 405 | sample of the invention | (A-7) | (1) | — |

TABLE 7-continued

| Sample No. | | Compound of Formula (A) | Compound of formula (I) | Cyan Coupler B-6 |
|---|---|---|---|---|
| 406 | sample of the invention | (A-3) | (1) | — |
| 407 | comparative sample | — | — | contained |
| 408 | comparative sample | (A-7) | — | contained |
| 409 | comparative sample | — | (12) | contained |
| 410 | sample of the invention | (A-7) | (12) | contained |
| 411 | sample of the invention | (A-7) | (1) | contained |
| 412 | sample of the invention | A-3) | (1) | contained |

These samples were evaluated in the same manner as in Example 1. Precisely, these samples were processed in the same manner as in Example 1, except that SC-50 Filter was not used for exposure, that the time for color development was 3 minutes and 15 seconds and that blue, green and red filters were used in measuring the density of each of the processed samples.

The results obtained are shown in Table 8, in which the density measured through a red filter is shown and the sensitivity measured at the point equaling to the minimum optical density plus 1.0 is shown.

TABLE 8

| Sample No. | | Properties of Sample Immediately After Coating | | Storability of Exposed Sample | | Storability of Sample Before Exposure | |
|---|---|---|---|---|---|---|---|
| | | Fog | Sensitivity | Variation in Fog | Variation in Sensitivity | Variation in Fog | Variation in Sensitivity |
| 401 | comparative sample | 0.25 | 0.0 (standard) | 0.15 | +0.18 | 0.09 | −0.12 |
| 402 | comparative sample | 0.24 | ±0 | 0.11 | +0.08 | 0.08 | −0.12 |
| 403 | comparative sample | 0.21 | −0.03 | 0.14 | +0.17 | 0.05 | −0.09 |
| 404 | sample of the invention | 0.21 | +0.01 | 0.08 | +0.03 | 0.03 | −0.06 |
| 405 | sample of the invention | 0.22 | ±0 | 0.07 | +0.02 | 0.02 | −0.05 |
| 406 | sample of the invention | 0.22 | −0.03 | 0.09 | +0.05 | 0.04 | −0.08 |
| 407 | comparative sample | 0.24 | +0.01 | 0.14 | +0.17 | 0.09 | −0.11 |
| 408 | comparative sample | 0.24 | +0.03 | 0.10 | +0.08 | 0.09 | −0.11 |
| 409 | comparative sample | 0.20 | −0.01 | 0.13 | +0.17 | 0.05 | −0.09 |
| 410 | sample of the invention | 0.21 | +0.06 | 0.07 | +0.02 | 0.02 | −0.03 |
| 411 | sample of the invention | 0.21 | +0.05 | 0.06 | ±0 | 0.02 | −0.03 |
| 412 | sample of the invention | 0.20 | +0.02 | 0.08 | +0.04 | 0.03 | −0.04 |

Table 8 showing the data of Sample Nos. 401 to 412 verifies that the samples of the present invention have the same effects as those of the samples of the invention in Example 1.

While the invention has been described in detail and with reference to specific embodimnents thereof, it will be apparent to one skilled in the art that various changes and modifications can be made therein without departing from the spirit and scope thereof.

What is claimed is:

1. A silver halide color photographic material comprising at least one negative silver halide emulsion layer on a support, wherein said material contains in at least one hydrophilic colloid layer provided on the support (i) at least one compound represented by formula (A) and (ii) at least one polymer having repeating units of formula (I) or (II):

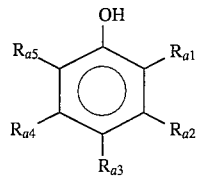

(A)

wherein $R_{a1}$ to $R_{a5}$ may be the same or different and each represents ① a hydrogen atom, ② a substituted or unsubstituted alkyl group, or ③ —X—$R_{a0}$, or ④ two of $R_{a1}$ to $R_{a5}$ which are ortho-positioned are bonded to each other to form a chroman ring with the benzene ring of formula (A); X represents —C($R_{a6}$)($R_{a7}$)—, —O— or —S—; $R_{a6}$ and $R_{a7}$ each represents a hydrogen atom or a substituted or unsubstituted alkyl group; and $R_{a0}$ represents a hydroxyphenyl group, except that $R_{a0}$ represents either a hydroxyphenyl group or a substituted or unsubstituted alkyl group when X is —C($R_{a6}$)($R_{a7}$)—, $R_{a6}$ and $R_{a7}$ both are substituted or unsubstituted alkyl groups and $R_{a1}$ and $R_{a5}$ both are —X—$R_{a0}$; provided that $R_{a3}$ must not be a hydrogen atom, that at least one of $R_{a1}$ to $R_{a5}$ is the group of ③ or ④, and that both $R_{a1}$ and $R_{a5}$ must not be hydrogen atoms when $R_{a3}$ is —X—$R_{a0}$ and $R_{a0}$ is a hydroxyphenyl group;

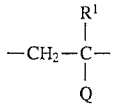

(I)

wherein $R^1$ represents a hydrogen atom or a substituted or unsubstituted alkyl group; and Q represents a group selected from the group consisting of groups represented by formulae 1) to 4):

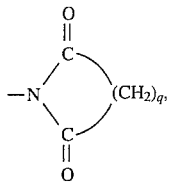

1)

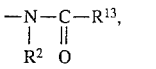

2)

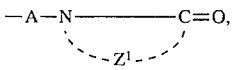

3)

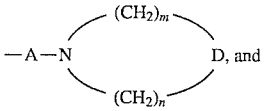

4)

wherein q represents an integer of from 2 to 4; $R^2$ and $R^{13}$ each represents a hydrogen atom or a substituted or unsubstituted alkyl group; $Z^1$ represents an atomic group necessary for forming a substituted or unsubstituted lactam ring, or a substituted or unsubstituted oxazolidone ring; A represents a chemical bond, —CO— or —CO—B—$(CH_2)$—; B represents —O— or —$NHR^4$— (wherein $R^4$ represents a hydrogen atom or a substituted or unsubstituted alkyl group); l represents an integer of from 1 to 6; D represents a single bond, —O—, or —$NR^5$—; m and n each represents an integer of from 1 to 6, provided that m+n=4 to 7; and $R^5$ represents a hydrogen atom, a substituted or unsubstituted alkyl group, or —$COR^6$ (wherein $R^6$ represents a substituted or unsubstituted alkyl group);

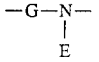

(II)

wherein E represents —$COR_{21}$, —$COOR_{22}$, —$CONHR_{23}$, —$CONHCOR_{24}$ or —$SO_2R_{25}$ wherein $R_{21}$, $R_{22}$, $R_{23}$, $R_{24}$ and $R_{25}$ each represent a substituted or unsubstituted alkyl, aryl or cycloalkyl group, or a hydrogen atom; and G represents a substituted or unsubstituted alkylene group having from 2 to 5 carbon atoms.

2. The silver halide color photographic material as in claim 1, wherein in Formula (A) at least one of the alkyl group which may be substituted, the aryl group which may be substituted, the cycloalkyl group which may be substituted, the alkalene group which may be substituted, the lactam ring which may be substituted, and the oxazolidone ring which may be substituted is substituted with at least one substituent selected from the group consisting of an alkyl group, an alkenyl group, an aryl group, a heterocyclic ring, a hydroxyl group, an alkoxy group, an aryloxy group, an alkoxycarbonyl group, an aryloxycarbonyl group, a halogen atom, an amino group, an alkylamino group, an arylamino group, an alkylthio group, an arylthio group, an alkyl- or aryl-sulfonyl group, an alkyl- or aryl-sulfinyl group, an alkyl- or aryl-sulfonamido group, an amido group, a carbamoyl group, a sulfamoyl group, an acyl group, an acyloxy group, a ureido group, an alkoxycarbonylamino group and an aryloxycarbonylamino group.

3. The silver halide color photographic material as in claim 1, wherein said compound represented by formula (A) is represented by formula (A-I) or (A-II);

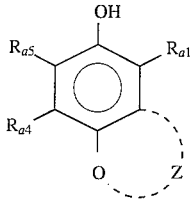

(A-I)

wherein $R_{a1}$, $R_{a4}$ and $R_{a5}$ have the same meaning as those in formula (A), Z represents an atomic group necessary for forming a substituted or unsubstituted ring to form a chroman ring with the benzene ring, said ring thus formed may be condensed with a carbon ring or a heterocyclic ring, or may be in the form of a spiro ring;

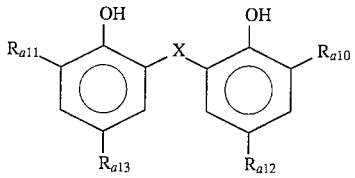

(A-II)

wherein X has the same meaning as in formula (A), $R_{a10}$ to $R_{a13}$ each represents a substituted or unsubstituted alkyl group.

4. The silver halide color photographic material as in claim 1, wherein said compound represented formula (A) is incorporated into at least one silver halide emulsion layer.

5. The silver halide color photographic material as in claim 1, wherein said compound represented by formula (A) is incorporated in an amount of from $1\times10^{-4}$ to 10 mol per mol of the silver halide in the layer when the compound is added into at least one silver halide emulsion layer containing the compound, or per mol of the silver halide in an adjacent silver halide emulsion layer (which contains larger amount of silver halide, if there are two adjacent silver halide emulsion layers) when the compound is added into a light-insensitive hydrophilic colloid layer.

6. The silver halide color photographic material as in claim 1, wherein $R^1$ in the repeating unit represented by formula (I) is a hydrogen atom and Q in the repeating unit is i)-a, i)-b, ii) or iii):

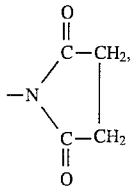

i)-a

-continued i)-b

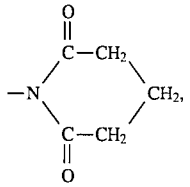

ii)

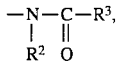

iii)

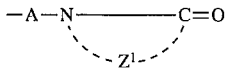

wherein $R^2$ represents a methyl group, or an ethyl group, $R^{13}$ represents a hydrogen atom, a methyl group or an ethyl group; A represents a single bond or —CO—, and $Z^1$ represents an atomic group nessary for forming a 5- to 6-membered lactam ring or an oxazolidone ring.

7. The silver halide color photographic material as in claim 1, wherein said polymer containing the repeating units represented by formula (I) is incorporated in an amount of from 0.02 to 10 g (in terms of the weight of the repeating units) per mol of silver in the photographic material.

8. The silver halide color photographic material as in claim 1, wherein said polymer containing the repeating units represented by formula (II) is incorporated into said at least one silver halide emulsion layer in an amount of from 1 to 500 g per 1 mol of silver halide in said silver halide emulsion layer.

9. The silver halide color photographic material as in claim 1, wherein said polymer containing the repeating units represented by formula (II) is incorporated into a light-insensitive auxiliary hydrophilic colloid layer provided on the support.

10. The silver halide color photographic material as in claim 1, wherein said photographic material contains a phenolic cyan coupler having a phenylureido group at the 2-position of the hydroxyphenyl group and a carbonamido group at the 5-position of the hydroxyphenyl group.

11. The silver halide color photographic material as in claim 10, wherein said phenolic cyan coupler is represented by formula (B);

(B)

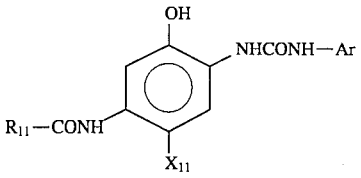

wherein $R_{11}$ represents an aliphatic group, an aromatic group or a heterocyclic group; Ar represents an aromatic group; and $X_{11}$ represents a hydrogen atom or a group capable of being split off from the coupler when the coupler is reacted with an oxidation product of an aromatic primary amine developing agent, said cyan coupler may be in a form of a dimer, a oligomer or a higher polymer.

12. The silver halide color photographic material as in claim 11, wherein said cyan coupler is incorporated into the photographic material in an amount of from $1.0\times10^{-5}$ to $3.0\times10^{-3}$ mol/m$^2$.

13. The silver halide color photographic material as in claim 12, wherein said at least one negative silver halide emulsion layer is a red-sensitive silver halide emulsion layer and said cyan coupler is incorporated thereinto.

14. The silver halide color photographic material as in claim 10, wherein said cyan coupler is incorporated into the layer which contains the compound represened by formula (A).

15. The silver halide color photographic material as in claim 1, wherein the silver halide grains in said at least one negative silver halide emulsion layer is subjected to reduction sensitization.

16. The silver halide color photographic material as in claim 15, wherein said silver halide emulsion layer subjected to reduction sensitization contains the compound represented by formula (A).

17. The silver halide color photographic material as in claim 15, wherein said reduction sensitization is applied to the inside of each grain of silver halide while the surface of the grain is oxidized.

18. The silver halide color photographic material as in claim 17, wherein the surface of the grain is oxidized using at least one compound represented by formulae (XI) to (XIII):

$$R—SO_2S—M \quad (XI)$$

$$R—SO_2S—R^1 \quad (XII)$$

$$R—SO_2S—Lm—SSO_2—R^2 \quad (XIII)$$

wherein, R, $R^1$ and $R^2$ may be the same or different and each represents an aliphatic group, an aromatic group or a heterocyclic group; M represents a cation; L represents a divalent linking group; and m is 0 or 1; said compound may be in the form of polymer having repeating units of the divalent group derived from the compound; and any two or more of R, $R^1$, $R^2$ and L may be bonded to each other to form ring(s).

* * * * *